US010136729B2

(12) United States Patent
Lin

(10) Patent No.: US 10,136,729 B2
(45) Date of Patent: Nov. 27, 2018

(54) FOLDING CHAIR

(71) Applicant: Yuan-Chun Lin, Taipei (TW)

(72) Inventor: Yuan-Chun Lin, Taipei (TW)

( * ) Notice: Subject to any disclaimer, the term of this patent is extended or adjusted under 35 U.S.C. 154(b) by 109 days.

(21) Appl. No.: 14/859,020

(22) Filed: Sep. 18, 2015

(65) Prior Publication Data

US 2016/0081479 A1 Mar. 24, 2016

(30) Foreign Application Priority Data

Sep. 19, 2014 (TW) ..... 103132348 A

(51) Int. Cl.
*A47C 4/04* (2006.01)
*A47C 4/14* (2006.01)
*A47C 4/24* (2006.01)

(52) U.S. Cl.
CPC ..... *A47C 4/04* (2013.01); *A47C 4/14* (2013.01); *A47C 4/24* (2013.01)

(58) Field of Classification Search
CPC .... A47C 4/04; A47C 4/24; A47C 4/14; A47C 1/02; A47C 5/06; A47C 4/38; A47C 4/48
USPC ..... 297/16.1, 46–48, 378.1
See application file for complete search history.

(56) References Cited

U.S. PATENT DOCUMENTS 122,834 A * 1/1872 Johnson ..... A47C 4/24 297/55
184,185 A * 11/1876 Sternberg ..... A47C 4/24 297/56
200,456 A * 2/1878 Hyde ..... A47C 4/14 297/52
441,466 A * 11/1890 Bowen ..... A47C 4/10 297/47
1,001,193 A * 8/1911 Fryman ..... A47C 4/24 297/53
1,018,074 A * 2/1912 Nordin ..... A47C 4/03 297/106
1,404,537 A * 1/1922 Mendelson ..... A47C 4/14 248/432
1,474,191 A * 11/1923 Freeze ..... A47C 4/20 297/47
1,693,349 A * 11/1928 Rastetter ..... A47C 4/14 297/48
2,314,130 A * 3/1943 Davis ..... A47C 1/028 248/398
3,220,764 A * 11/1965 Duer ..... A47C 4/24 108/120
5,464,268 A * 11/1995 Levrangi ..... A47C 3/36 248/164

(Continued)

FOREIGN PATENT DOCUMENTS

GB 190925912 A * 11/1910 ..... A47C 4/38

*Primary Examiner* — Brian E Glessner
*Assistant Examiner* — Adam G Barlow
(74) *Attorney, Agent, or Firm* — Alan D. Kamrath; Kamrath IP Lawfirm, P.A.

(57) ABSTRACT

A folding chair includes a seat, a back, an interlinking device, a front leg, and a rear leg. The seat, the back, the interlinking device, the front leg, and the rear leg are interlinked. The seat includes at least one guiding portion, and the interlinking device includes at least one actuating member, which is movably coupled to the guiding portion. A user can fold or unfold the folding chair by a single-handed operation, such as pushing or pulling on the back or pulling a handle.

24 Claims, 39 Drawing Sheets

(56) References Cited

U.S. PATENT DOCUMENTS

| | | | | |
|---|---|---|---|---|
| 6,186,593 | B1 * | 2/2001 | Garneau | A47B 83/008 248/464 |
| 6,340,205 | B1 * | 1/2002 | Battiston | A47C 4/24 108/119 |
| 7,017,986 | B2 * | 3/2006 | Degen | A47C 4/20 297/447.2 |
| 7,185,948 | B2 * | 3/2007 | Liu | A47C 1/035 297/16.1 |
| 7,273,249 | B1 * | 9/2007 | Tseng | A47C 4/10 297/16.1 |
| 8,231,171 | B2 * | 7/2012 | Leng | A47C 4/24 297/41 |
| 8,882,188 | B2 * | 11/2014 | Jin | A47C 4/24 297/46 |
| 2008/0284216 | A1 * | 11/2008 | Mayercheck | A47C 4/14 297/46 |
| 2015/0097357 | A1 * | 4/2015 | Herbault | B62B 7/086 280/647 |
| 2016/0150884 | A1 * | 6/2016 | Yip | A47C 1/026 297/19 |
| 2016/0338492 | A1 * | 11/2016 | Piretti | A47C 4/04 |

* cited by examiner

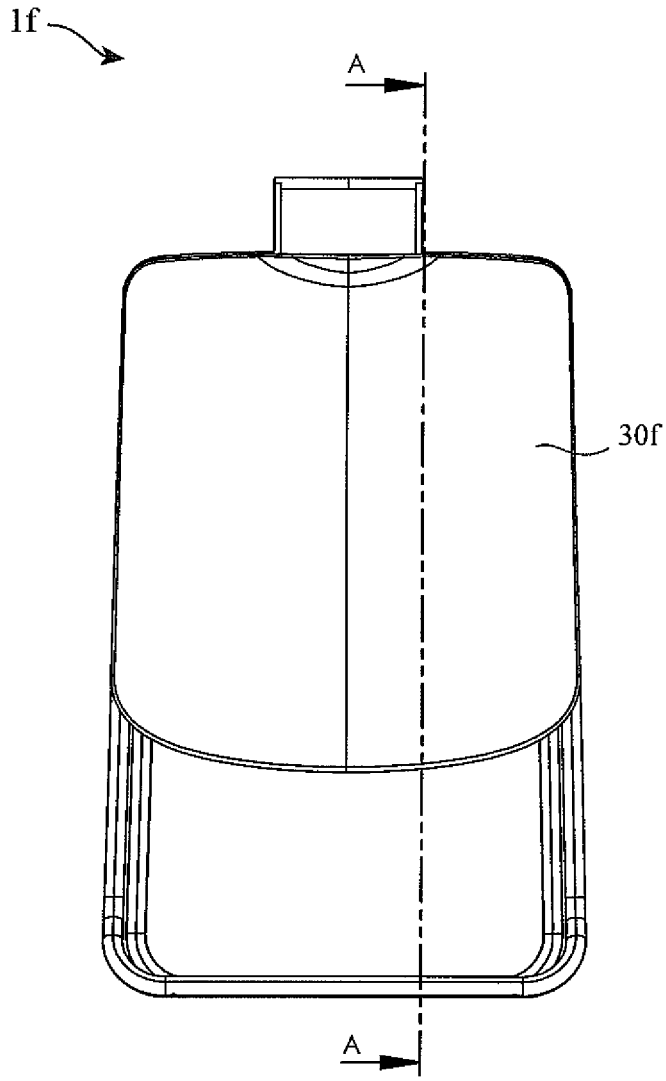
Fig. 15D
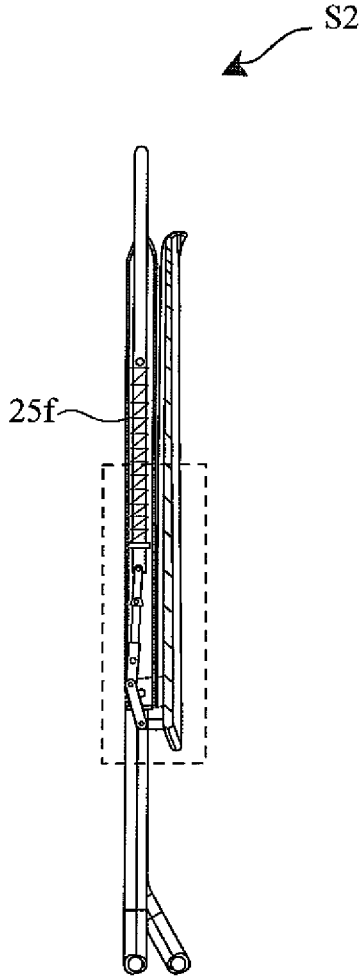
Fig. 15E
Fig. 15F
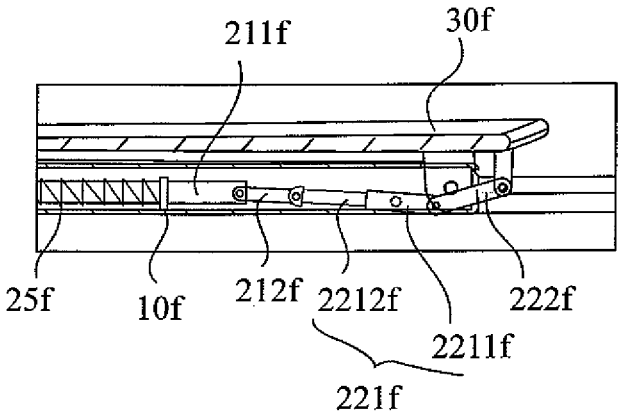

FOLDING CHAIR

BACKGROUND OF THE INVENTION

1. Field of the Invention

The present invention relates to a foldable chair.

2. Description of the Related Art

Regular chairs have fixed structures and are not capable of folding. Therefore, there are many kinds of folding chairs on the market, which are easier to store than non-folding chairs. Users can arrange their spaces and store the chairs more flexibly and efficiently.

However, conventional folding chairs still have several disadvantages. For example, the folded height of conventional folding chairs is usually higher than the height from the floor to an adult's hand, which is too high for users to carry the chairs easily. Therefore, it is inconvenient and tiring to lift up a conventional folding chair to avoid hitting the floor when transporting a conventional folding chair, and the design of the conventional folding chair may cause safety issues. Regarding this issue, some folding chairs are designed such that the total length of the chair is reduced for more efficient storage and transportation, such as the chair described in U.S. Pat. No. 8,882,188, with the folded height being decreased. However, since the folding mechanism of the prior art is exposed at the top and at both sides of the seat, the user might touch the mechanism when seated. The exposed mechanism has the potential to cause injury to the user when the chair is being folded, unfolded or sat upon. Additionally, as with other conventional folding chairs, a large hole is provided in the back of the chair for disposition of the folding mechanism, and this type of chair is less comfortable to sit on than regular chairs. Furthermore, a common issue with conventional folding chairs is that such chairs require the user to use two hands to fold or unfold the chairs. In the prior art, despite the reduced size, it is not easy to fold or unfold the chair with one hand, which may cause inconvenience to the users, especially elderly or disabled people. Finally, conventional folding chairs can be stored in only a few ways, which limits the possibilities and flexibility to arrange spaces freely, since conventional folding chairs can only be leaned against a wall or laid on the floor when they are folded.

SUMMARY OF THE INVENTION

It is an object of the present invention to provide a folding chair that can be operated easily by one-handed operation, such as folding or unfolding the folding chair by pushing or pulling on the back of the chair with a single hand.

It is another object of the present invention to provide a folding chair that can be operated easily by one-handed operation, such as folding or unfolding the folding chair by pushing or pulling a handle of the chair with a single hand.

It is further another object of the present invention to provide a folding chair having a decreased size when folded, with the folding mechanism not exposed and minimized. Such a folding mechanism has a lower risk of being accidentally damaged by users when they sit on the chair, and the user will have a lower risk of being injured by the folding mechanism when sitting on or operating the chair. Such a hidden mechanism will also increase the aesthetic value of the chair and provide a more comfortable sitting experience.

It is further another object of the present invention to provide a folding chair that can be operated conveniently.

When the chair is folded, the structure is slim, and the chair is capable of standing without external support and is easy to carry, transport and store.

To achieve the aforementioned objects, the folding chair of the present invention has an unfolded state and a folded state. The folding chair of the present invention comprises a back, a seat, an interlinking device, a front leg and a rear leg.

The seat comprises a front end, a rear end, and a guiding portion. The back and the seat are pivotally connected. The interlinking device comprises an actuating member and a linking mechanism. The actuating member is movably coupled to the guiding portion of the seat, and the back and the actuating member are coupled by the linking mechanism. The front leg is pivotally connected to the actuating member, and the rear leg is pivotally connected to the seat. At the same time, the front leg comprises a leg coupling member, and the front leg and the rear leg are pivotally connected by the leg coupling member.

In the unfolded state, the back of the folding chair is unfolded, and the front leg and the rear leg are unfolded. In the folded state, the front leg and the rear leg are folded, the back and the seat are folded, and the back, the front leg and the rear leg of the folding chair are all close to the seat.

By virtue of the aforementioned structure, the back, the seat, the interlinking device, the front leg and the rear leg are interlinked such that a user can push or pull on the back with a single hand to activate the interlinking device and alternate the folding chair between the unfolded state and the folded state.

According to one of the preferred embodiments of the present invention, the back comprises a handhold portion for the user to grip. When the user pulls on the back, the interlinking device will be activated and then unfold the chair.

According to one of the preferred embodiments of the present invention, the folding chair is capable of folding by itself and then standing without support in the folded state after a user pushes on the back slightly.

According to one of the preferred embodiments of the present invention, the interlinking device comprises an initial activating member that can be grasped and is connected to the actuating member. When the user pulls the initial activating member, it will activate the interlinking device to fold the chair.

According to one of the preferred embodiments of the present invention, the rear leg comprises a leg sliding portion so that the leg coupling member can move along the leg sliding portion.

According to one of the preferred embodiments of the present invention, other than connecting the back to the actuating member, the linking mechanism can also connect the back to the front leg or the rear leg.

According to one of the preferred embodiments of the present invention, the folding chair of the present invention can stand in the folded state on a surface, without external support.

According to one of the preferred embodiments of the present invention, the actuating member comprises a main actuating member and a secondary actuating member.

According to one of the preferred embodiments of the present invention, the linking mechanism comprises a rotary member and a back coupling member.

BRIEF DESCRIPTION OF THE DRAWINGS

FIG. 15 and FIGS. 15A to 15H provide perspective views, cross-sectional views and partial enlarged views showing the unfolded state and the folded state of the folding chair according to a seventh embodiment of the present invention.

DETAILED DESCRIPTION OF THE PREFERRED EMBODIMENTS

The advantages and innovative features of the invention will become more apparent from the following detailed descriptions when taken together with the accompanying drawings.

Figure 1:
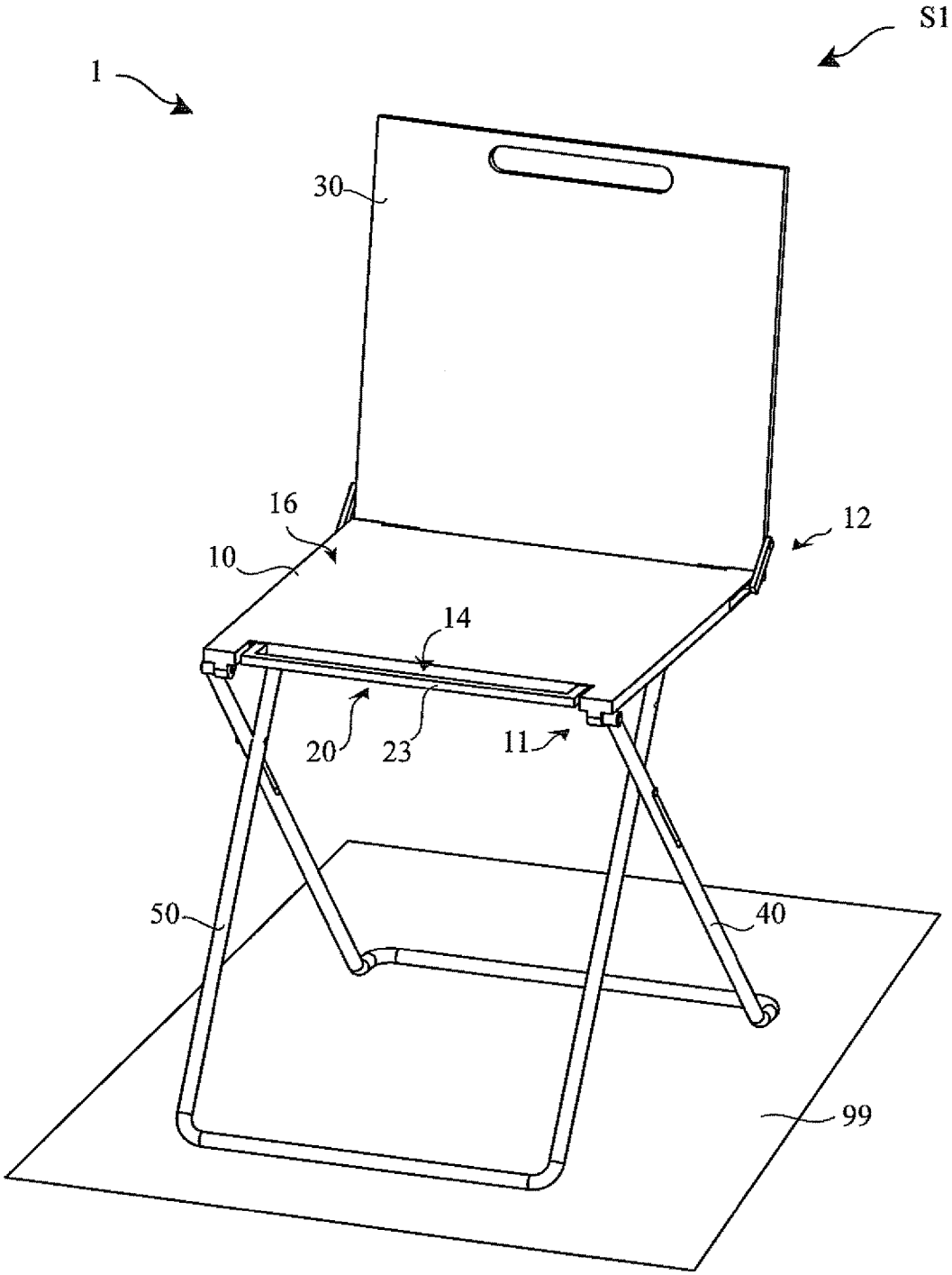
FIG. 1 provides a perspective view of the unfolded state of the folding chair according to a first embodiment of the present invention.
Figure 2:
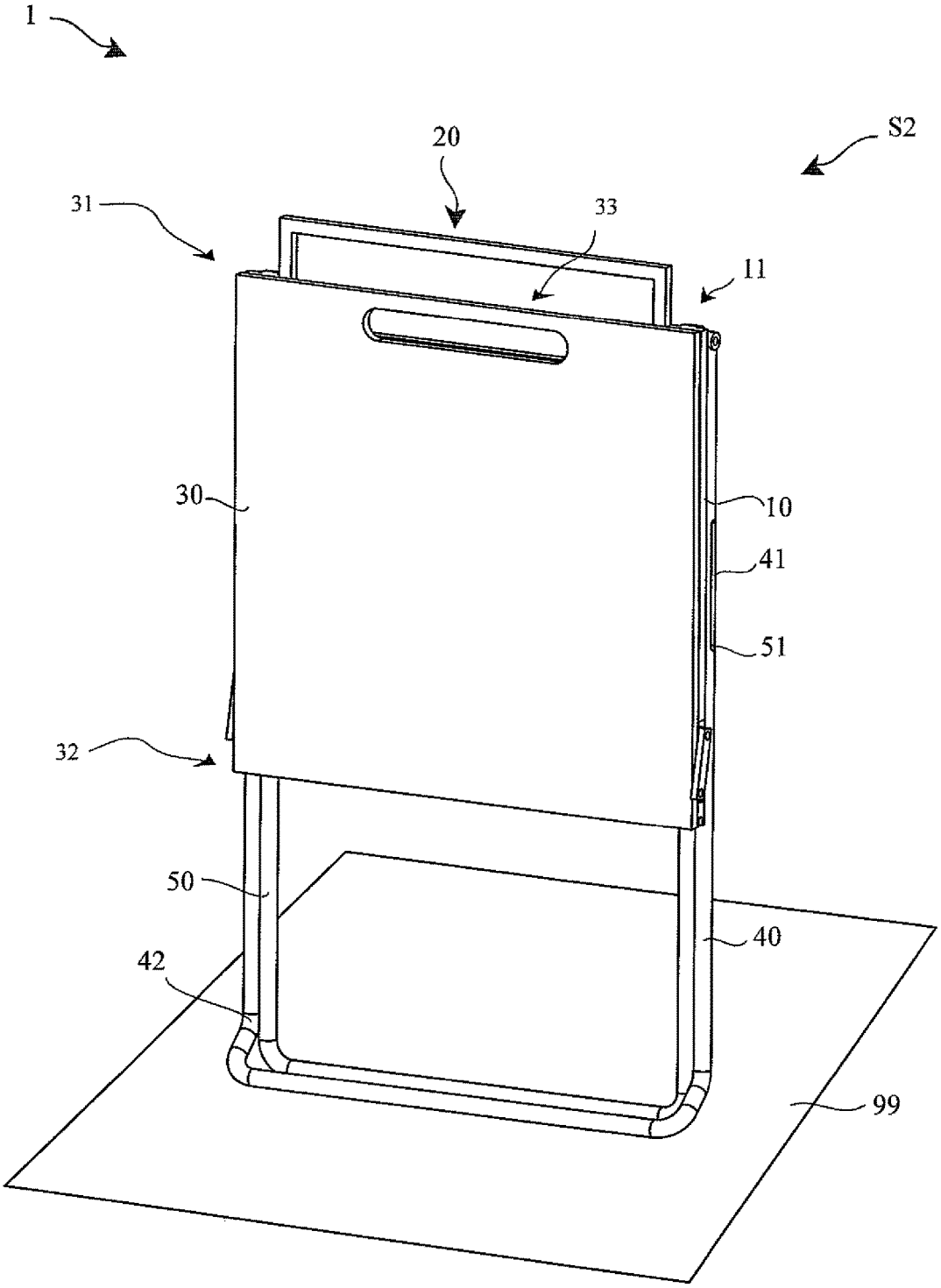
FIG. 2 provides a perspective view of the folded state of the folding chair according to the first embodiment of the present invention.
Figure 3:
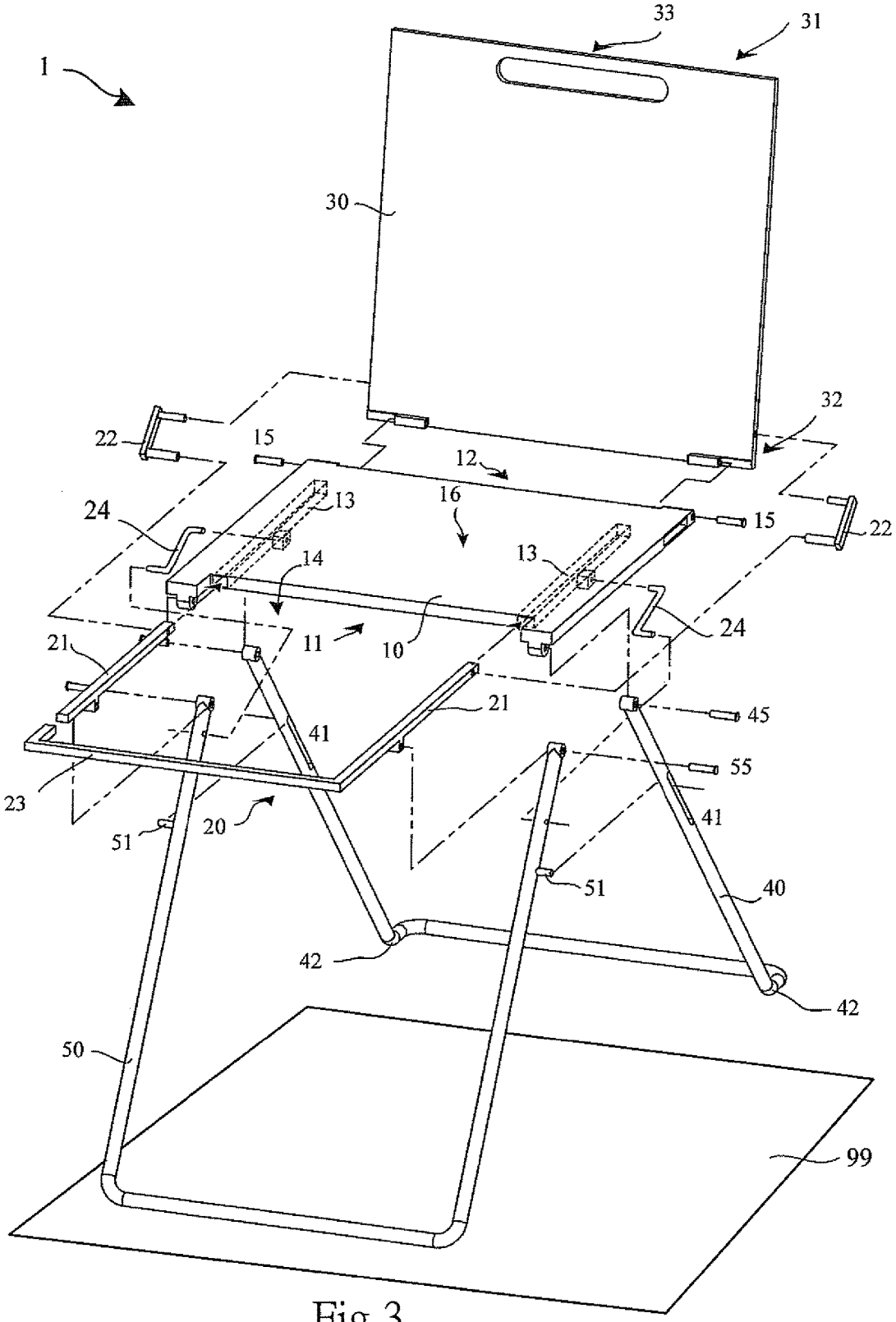
FIG. 3 provides an exploded view of the folding chair according to the first embodiment of the present invention.

Please refer to FIGS. 1 to 3. A folding chair of the present invention comprises a seat 10, an interlinking device 20, a back 30, a rear leg 40, and a front leg 50.

The seat 10 comprises a front end 11, a back lower end 12, and a pair of the guiding portions 13. In this embodiment, the guiding portions 13 are a pair of long grooves, which are disposed in the direction from the front end 11 to the back lower end 12. Additionally, the front end 11 comprises an opening 14.

The back 30 comprises an upper end 31, a back lower end 32 and a handhold portion 33. The handhold portion 33 is not restricted to any specific shape or design. The purpose of the handhold portion 33 is to allow the user to grip the back 30 more easily. The handhold portion 33 is a hole in this embodiment.

The interlinking device 20 comprises a pair of actuating members 21, a linking mechanism 22, an initial activating member 23 and a pair of leg guiding members 24. In this embodiment, the actuating members 21 are a pair of long rods which are able to slide. The actuating members 21 are movably coupled (e.g., can be rotated, moved, or slid) to the guiding portions 13. In this embodiment, the linking mechanism 22 is a pair of linkages which connect the back 30 and the pair of actuating members 21. It should be noted that the linking mechanism 22 can consist of a single or multiple linkages. In addition, the back 30 and the seat 10 are pivotally coupled through two connecting members 15. The initial activating member 23 is coupled to the actuating members 21. The initial activating member 23 is not restricted to a specific design or shape because the main objective of the initial activating member 23 is to allow the user to fold the chair by triggering it. The initial activating member 23 is a U-shaped handle in this embodiment. In this embodiment, the leg guiding member 24 is a linkage connecting the front leg 50 and the seat 10, and the position where the leg guiding member 24 and the seat 10 is connected is between the front leg 50 and the back 30, but it can also be between the front leg 50 and the rear leg 40 (not shown).

The rear leg 40 and the front leg 50 resemble a U shape in this embodiment. The front leg 50 comprises a leg coupling member 51. The front leg 50 is pivotally coupled to the rear leg 40 by the leg coupling member 51. A pivoting member 45 connects the rear leg 40 to the seat 10, and the front leg 50 is pivotally coupled to the actuating members 21 by a pivoting member 55.

The seat 10, the back 30, the interlinking device 20, the front leg 50, and the rear leg 40 are interlinked such that the folding chair 1 can have an unfolded state S1 and a folded state S2.

Please refer to FIG. 1. In the unfolded state S1, the back 30 of the folding chair 1 is unfolded, the rear leg 40 and the front leg 50 are unfolded, and the initial activating member 23 is located at the opening 14 of the seat 10, where users can easily grasp the initial activating member 23.

Please refer to FIG. 2. In the folded state S2, the front leg 50 and the rear leg 40 are in close proximity to each other, and the back 30 and the seat 10 are in close proximity to each other. In other words, in the folded state S2, the back 30, the front leg 50, and the rear leg 40 are all close to the seat 10. In this embodiment, the rear leg 40 comprises a leg sliding portion 41. The leg sliding portion 41 is a slot in this embodiment and allows the leg coupling member 51 to move along the leg sliding portion 41 of the rear leg 40. Therefore, the relative positions of the front leg 50 and the rear leg 40 are adjustable. In this embodiment, the rear leg 40 further comprises a bent part 42 which is an acute angle in shape. In the folded state S2, the folding chair 1 is supported by the front leg 50 and the rear leg 40 and is thus able to stand without external support on a surface 99.

Figure 4:
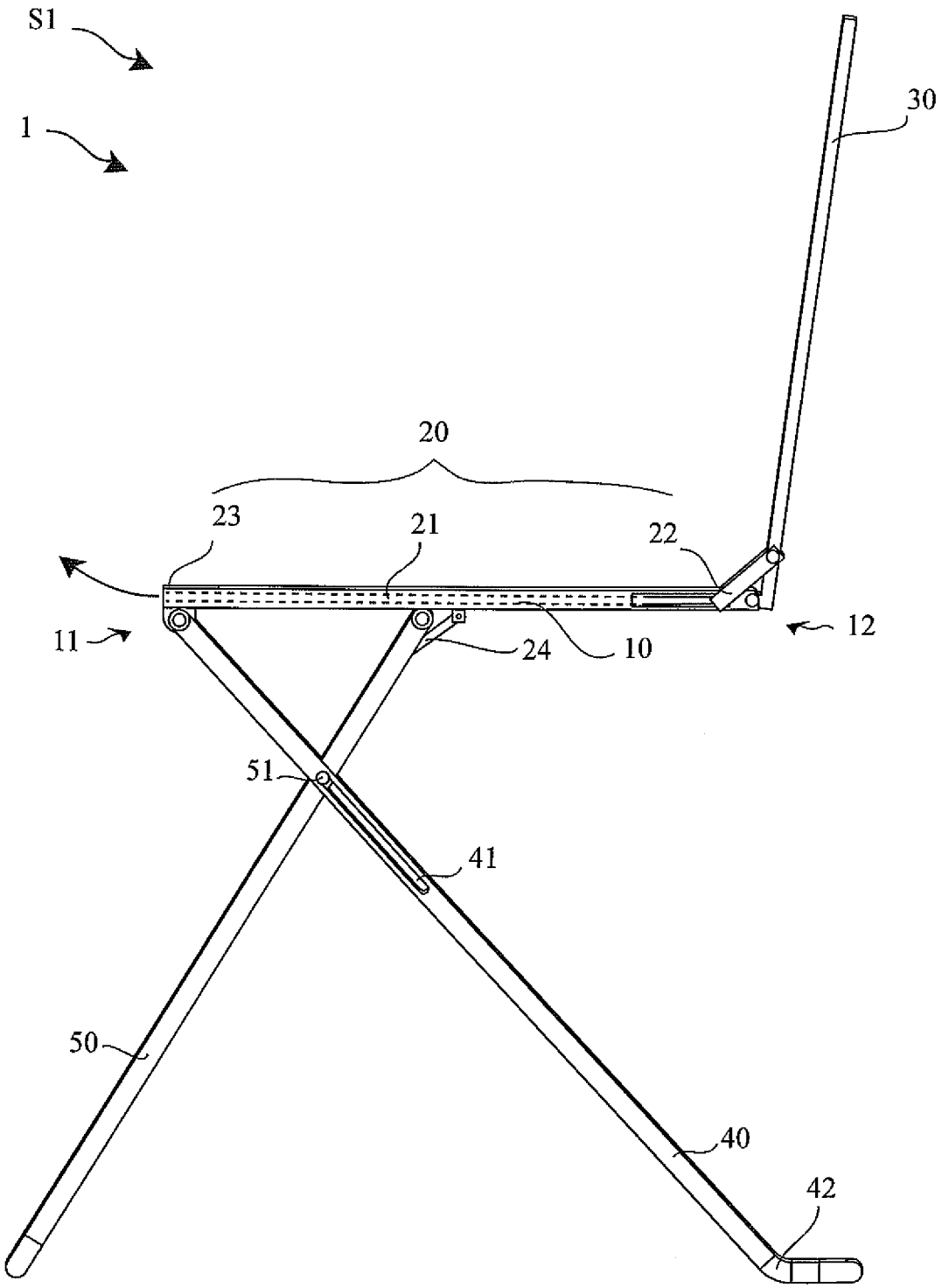
FIG. 4 and FIG. 4A are schematic drawings showing the folding chair in the state before it transitions from the unfolded state to the folded state according to the first embodiment of the present invention.
Figure 4A:
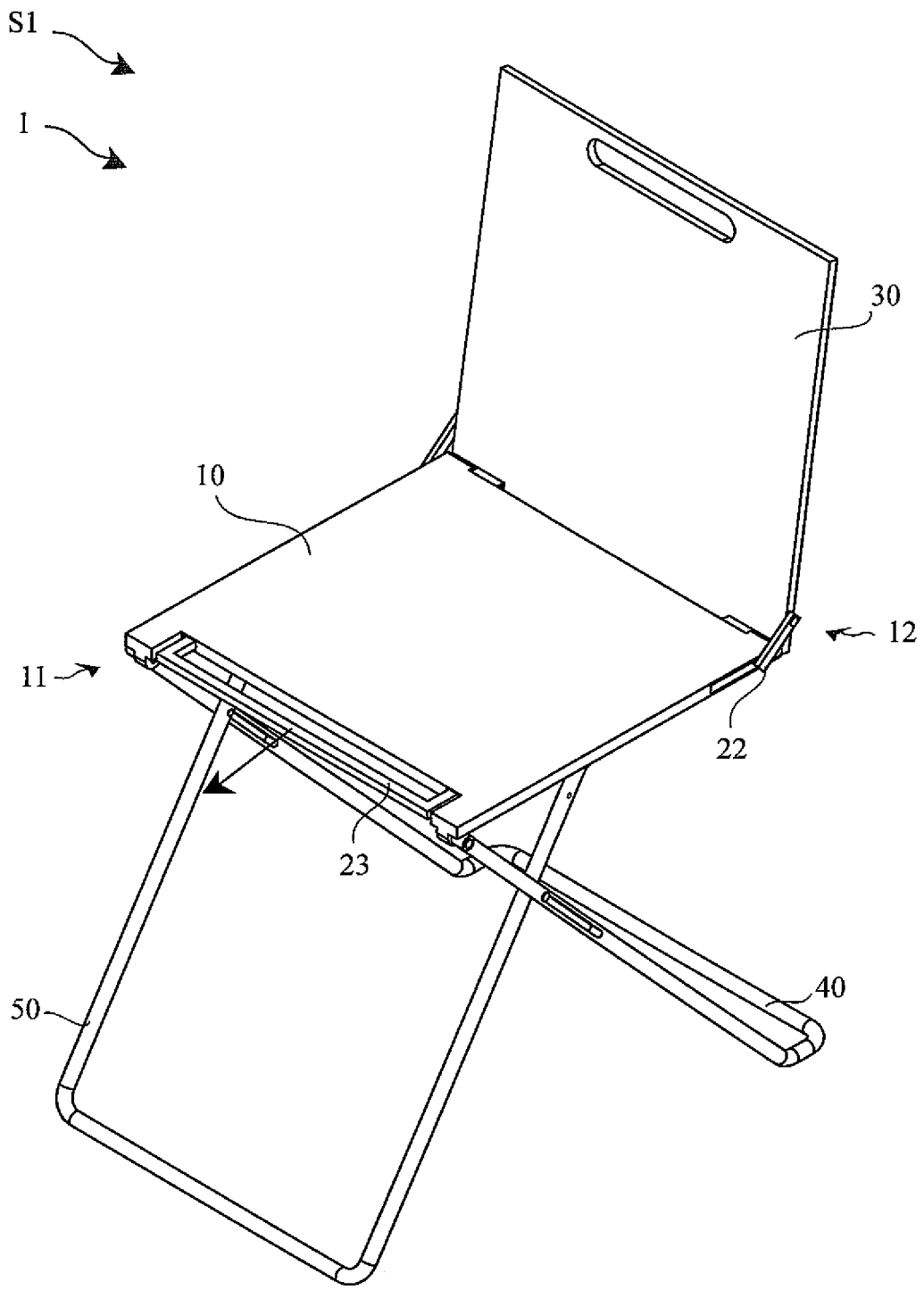
Figure 5:
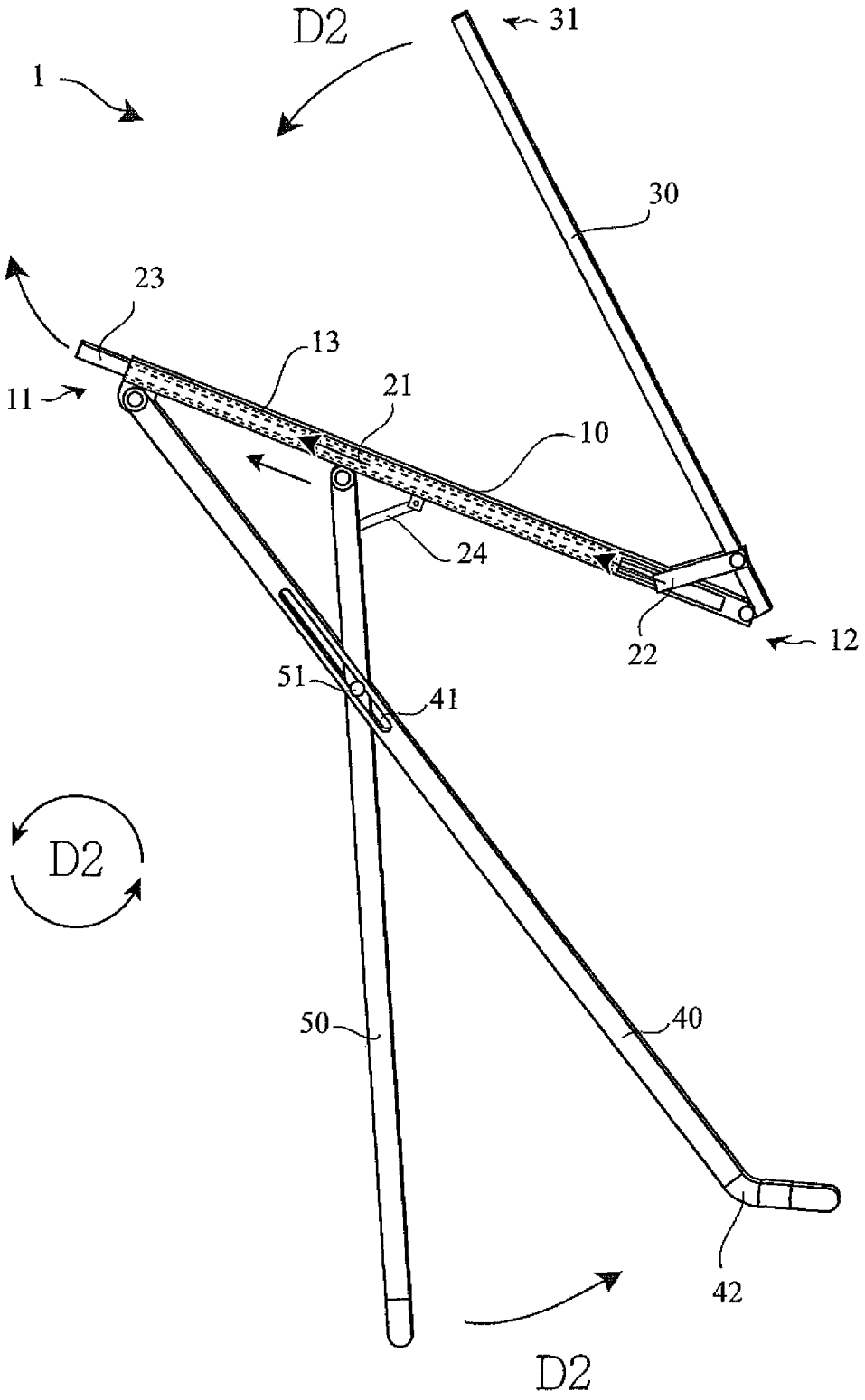
FIG. 5 and FIG. 5A are schematic drawings showing the process of transition from the unfolded state to the folded state of the folding chair according to the first embodiment of the present invention.
Figure 5A:
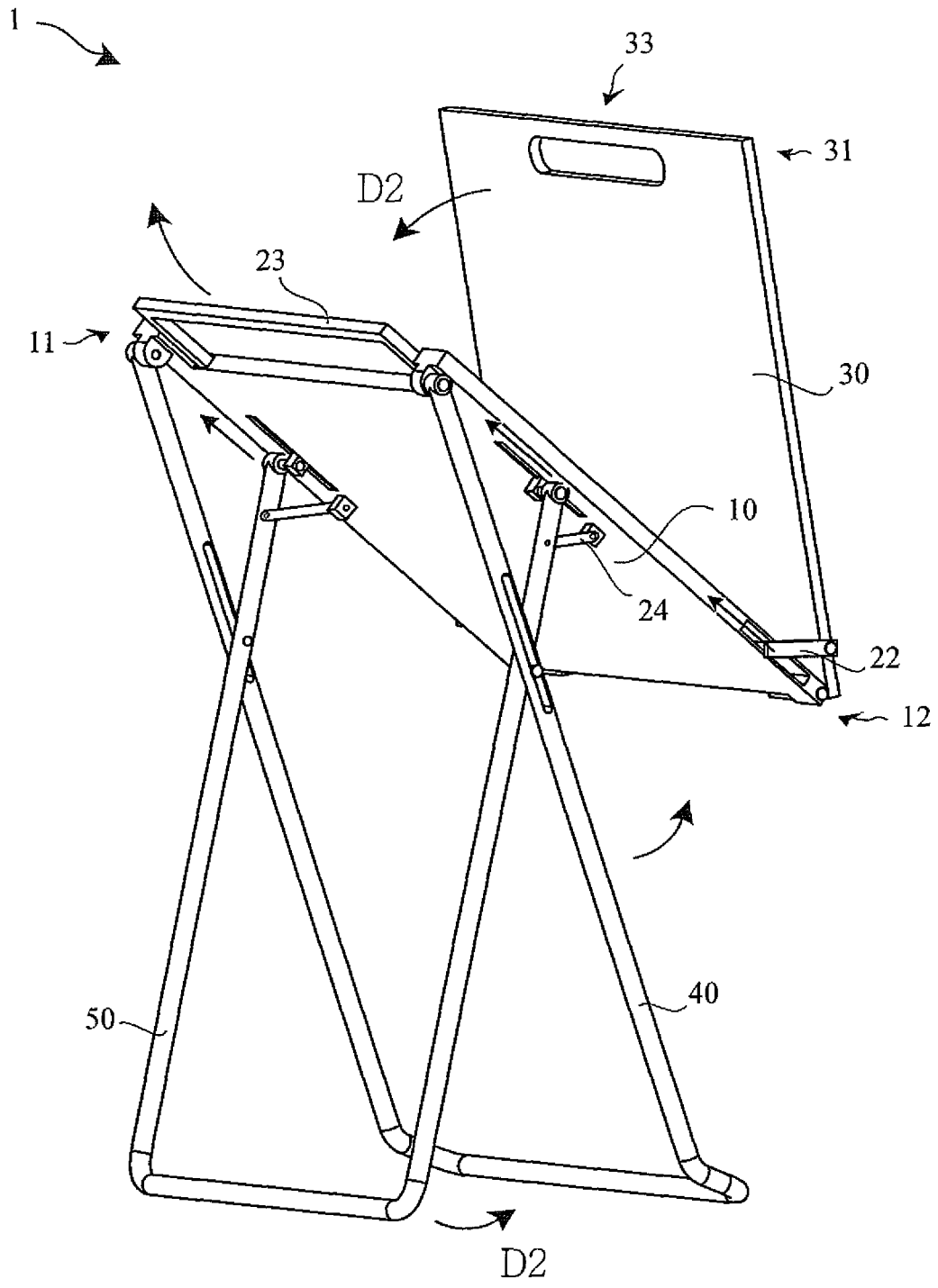
Figure 6:
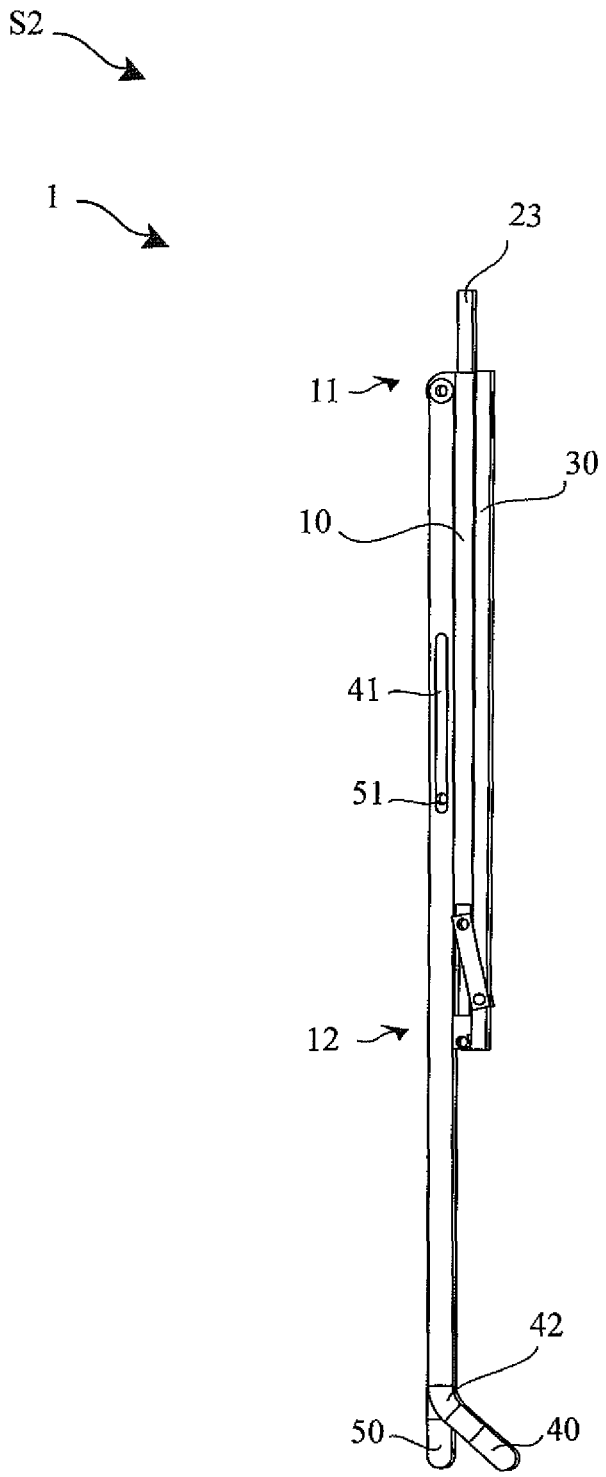
FIG. 6 and FIG. 6A are schematic drawings showing the folding chair after it has transitioned completely from the unfolded state to the folded state according to the first embodiment of the present invention.
Figure 6A:
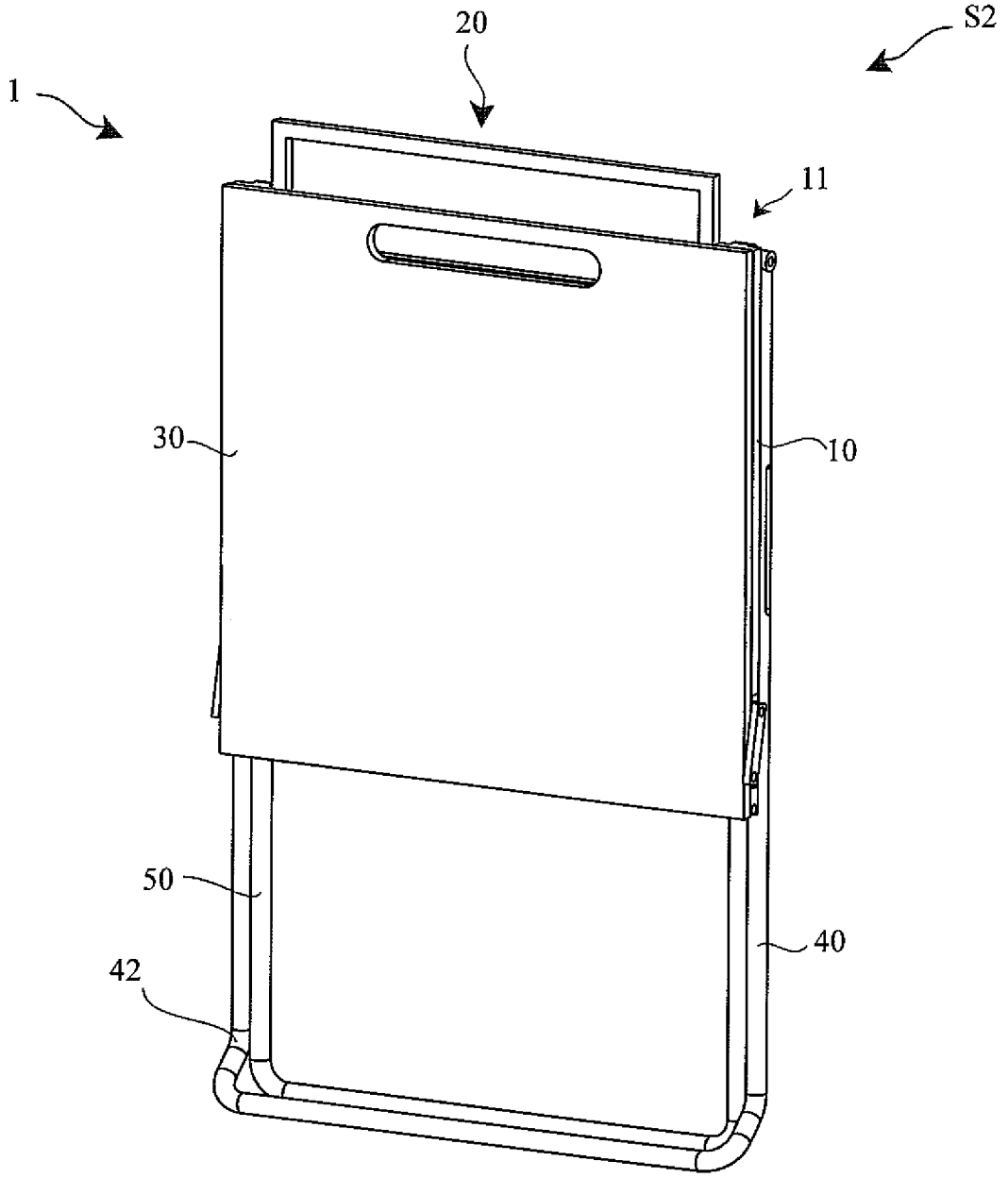

Please refer to FIGS. 4 to 6A, which illustrate the movement of the folding chair 1 according to the first embodiment of the present invention. In the unfolded state S1, users can pull the initial activating member 23 and lift up the folding chair 1 (FIG. 4, FIG. 4A) to cause the actuating members 21 to move along the direction from the rear end 12 to the back lower end 11. This motion drives the front leg 50 and the rear leg 40 to rotate simultaneously and approach each other along a counterclockwise folding direction D2. Meanwhile, the upper end 31 of the back 30 rotates toward the front end 11 of the seat 10 along the counterclockwise folding direction D2 (FIG. 5, FIG. 5A) and transitions the folding chair 1 from the unfolded state S1 into the folded state S2 (FIG. 6, FIG. 6A). The user can also push the back 30 to actuate the folding function. Please refer to the seventh embodiment shown in FIG. 15I.

Figure 7:
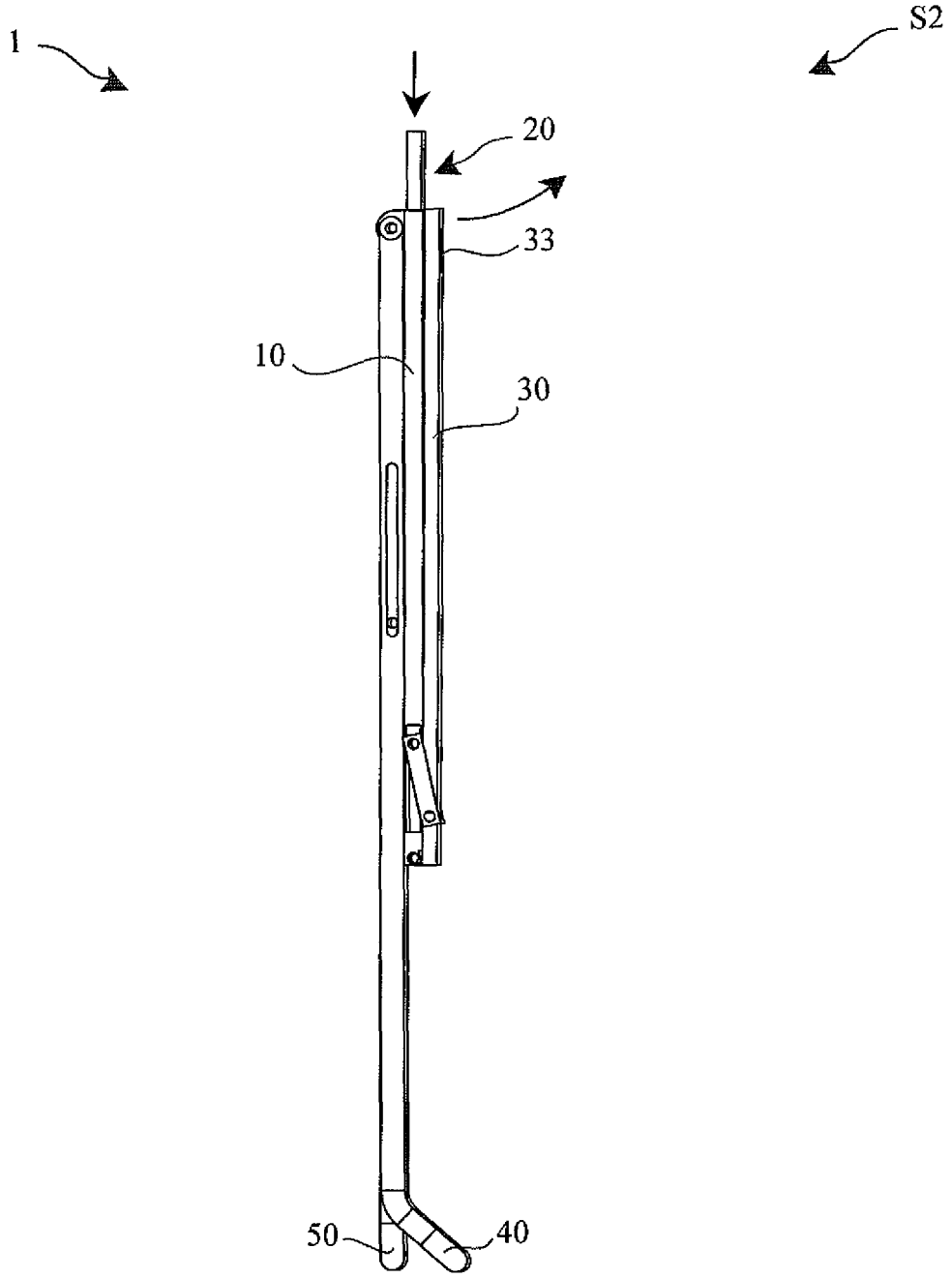
FIG. 7 and FIG. 7A are schematic drawings showing the folding chair in the state before it transitions from the folded state to the unfolded state according to the first embodiment of the present invention.
Figure 7A:
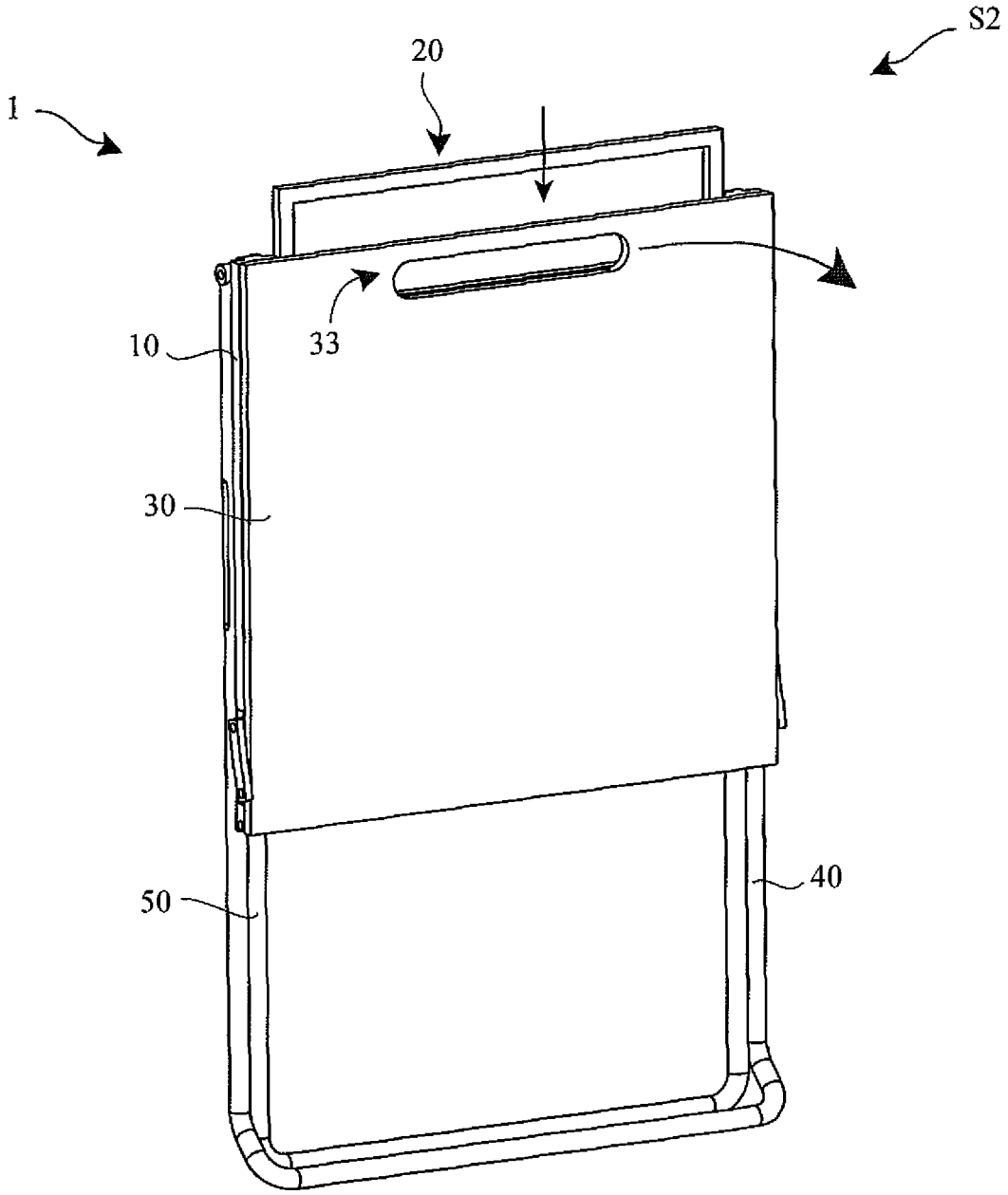
Figure 8:
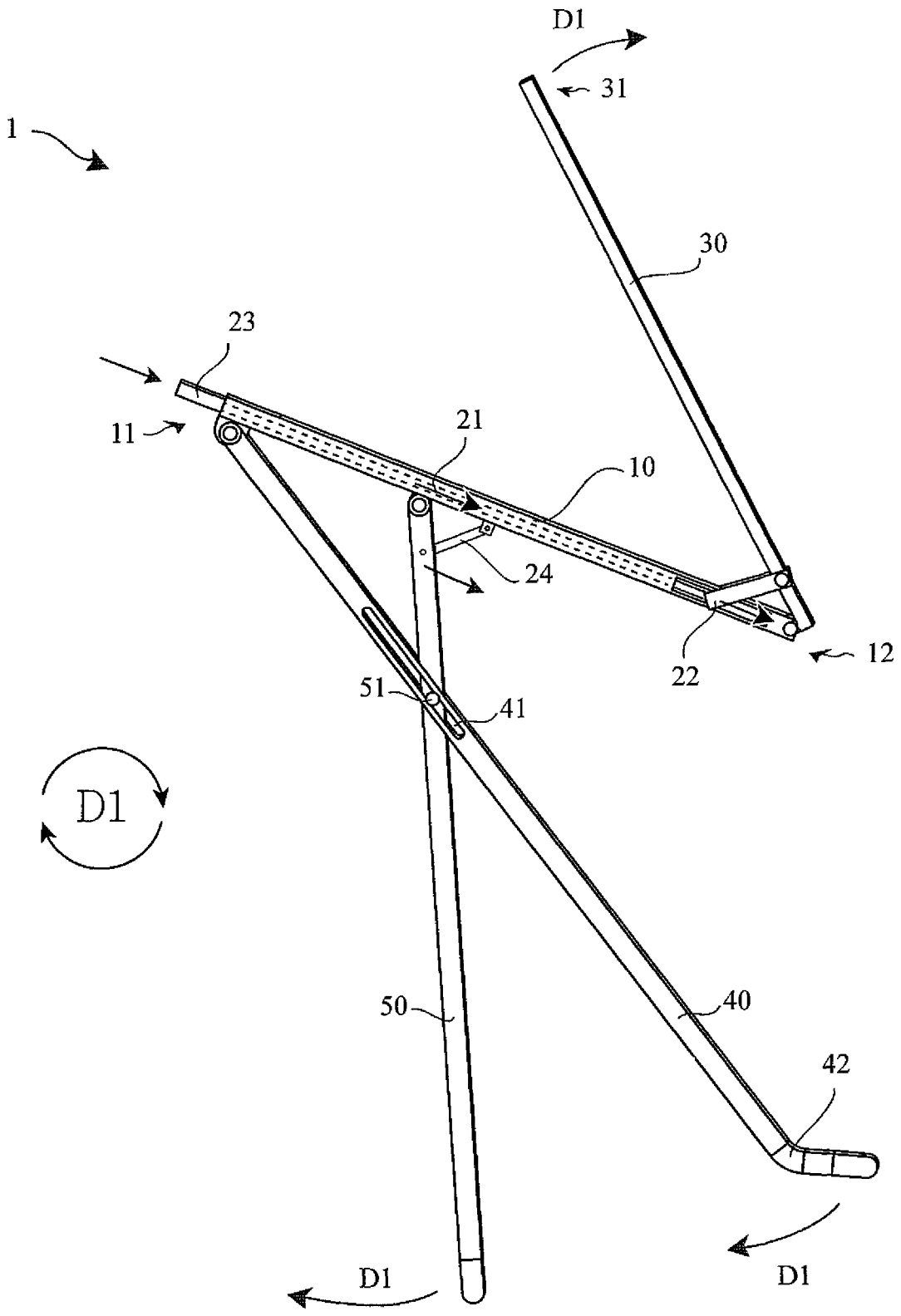
FIG. 8 and FIG. 8A are schematic drawings showing the transition process from the folded state to the unfolded state according to the first embodiment of the present invention.
Figure 8A:
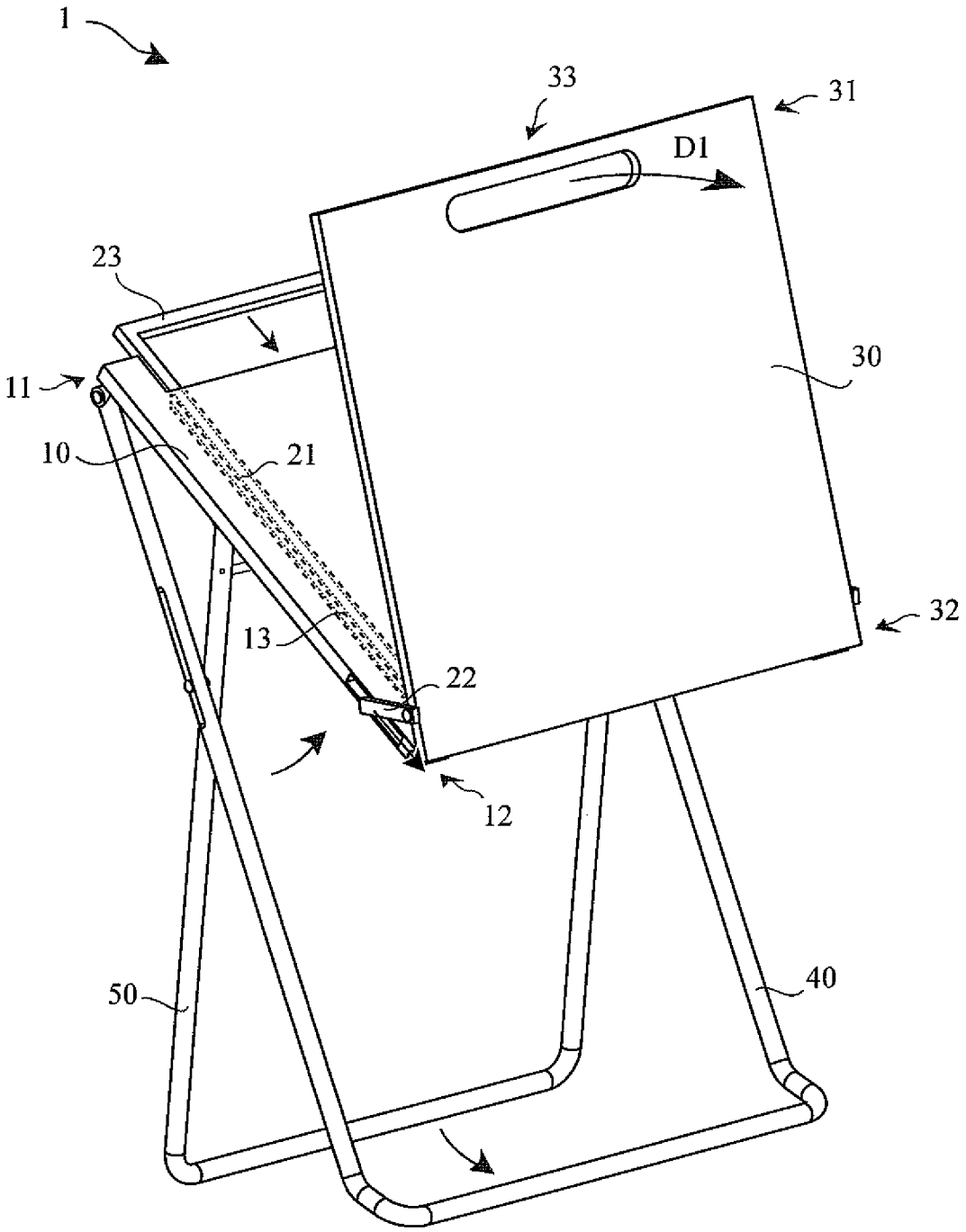
Figure 9:
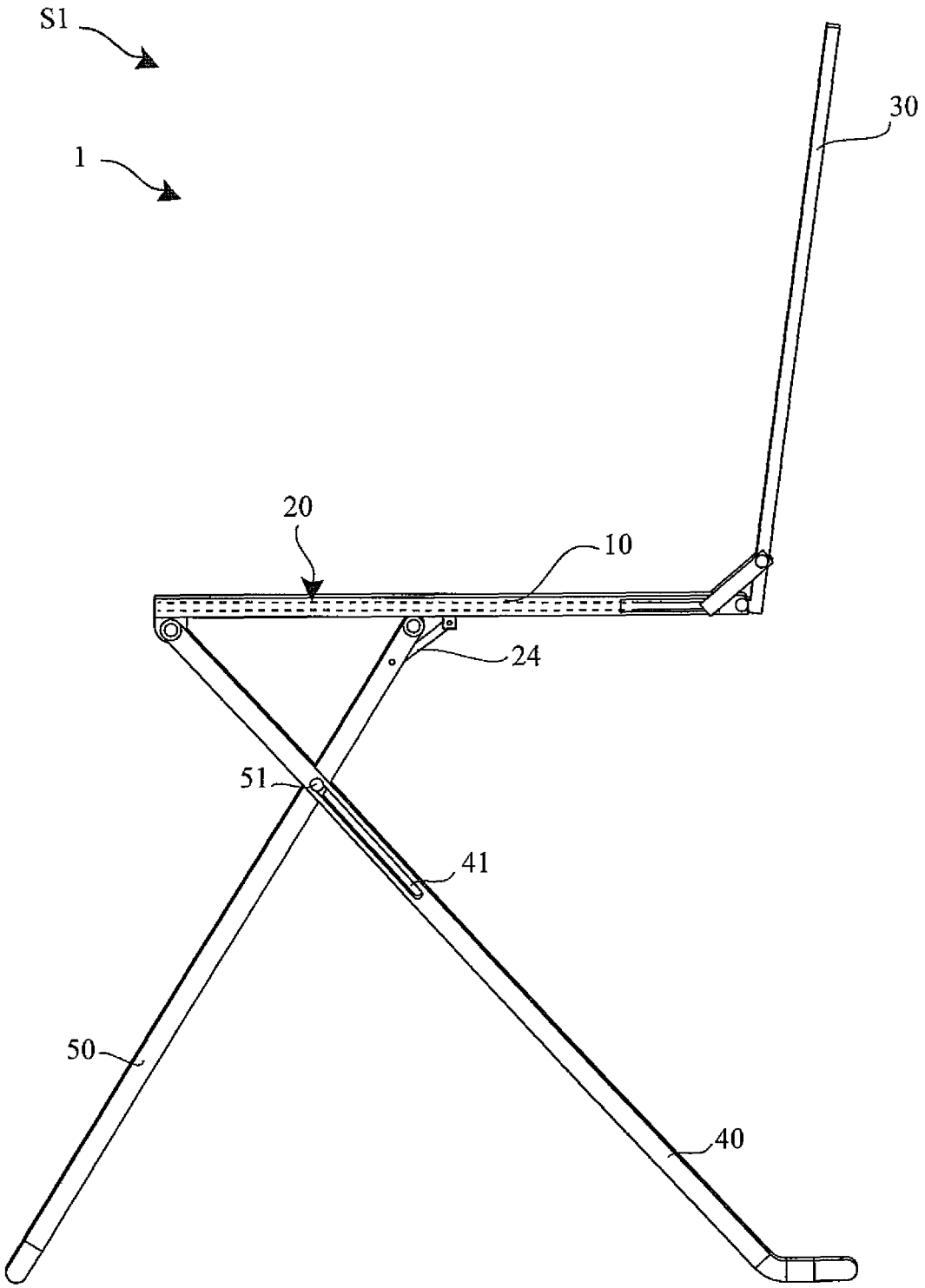
FIG. 9 and FIG. 9A are schematic drawings showing the folding chair after it has transitioned completely from the folded state to the unfolded state according to the first embodiment of the present invention.
Figure 9A:
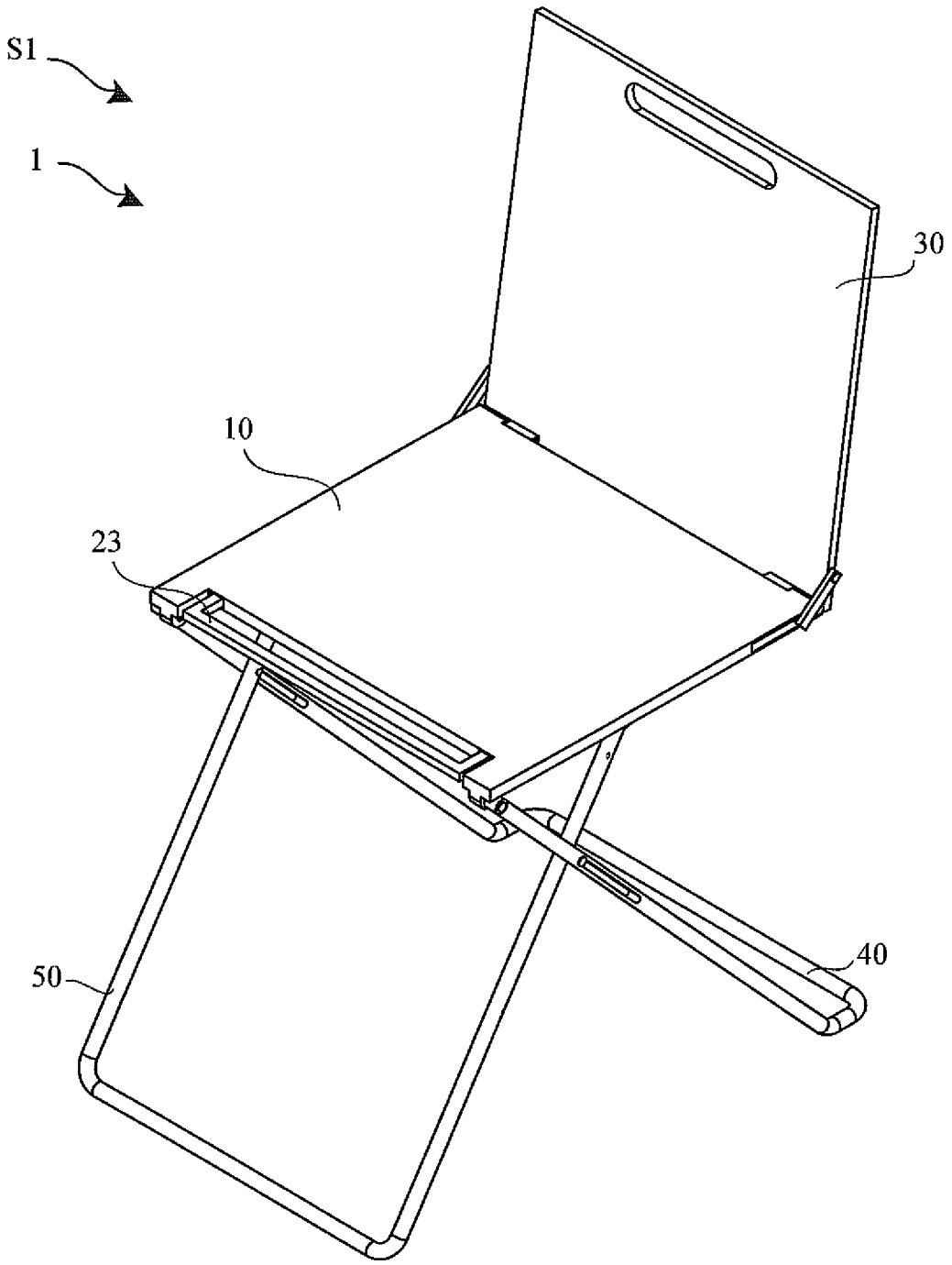

Please refer to FIGS. 7 to 9A. In the folded state S2, the upper end 31 is above the back lower end 32, and users can grasp the handhold portion 33 (FIG. 7, FIG. 7A, which is a hole in this embodiment) and rotate the back 30 in a clockwise unfolding direction D1, which causes the upper end 31 of the back 30 and the front end 11 of the seat 10 to recede. Meanwhile, the linking mechanism 22 drives the actuating members 21 to move along the direction from the front end 11 to the back lower end 12 to drive the front leg 50 and the rear leg 40 to unfold along the clockwise unfolding direction D1 (FIG. 8, FIG. 8A) and finally to transition the folding chair 1 from the folded state S2 into the unfolded state S1 (FIG. 9, FIG. 9A).

Figure 10:
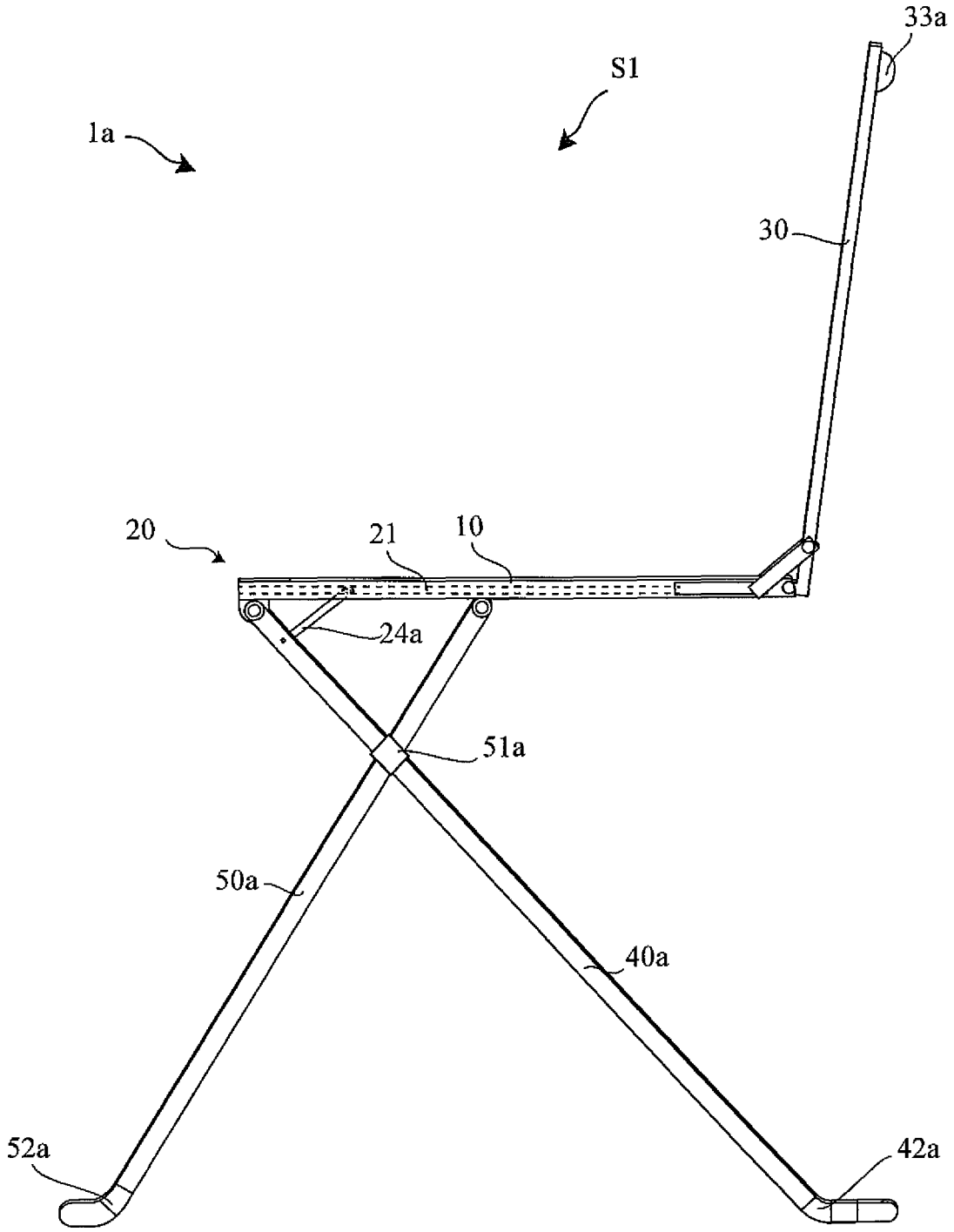
FIG. 10 and FIG. 10A provide perspective views of the unfolded state and the folded state of the folding chair respectively according to a second embodiment of the present invention.
Figure 10A:
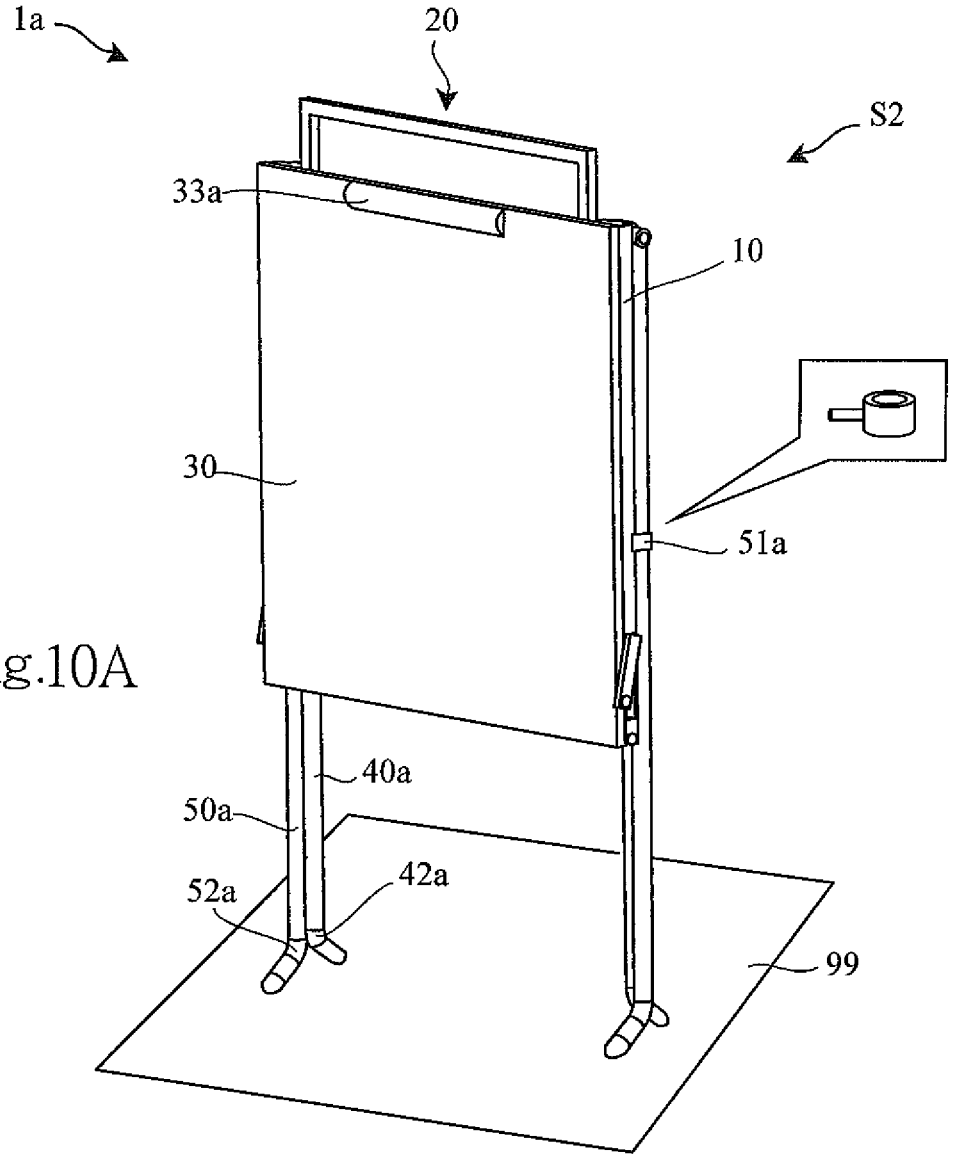
Figure 10B:
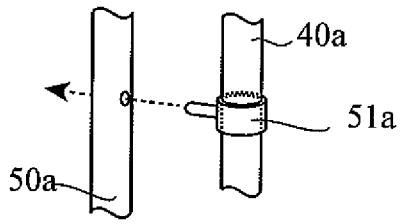
FIG. 10B and FIG. 10C provide exploded views and schematic drawings showing the front leg, the rear leg and the leg coupling member of the folding chair according to the second embodiment of the present invention.
Figure 10C:
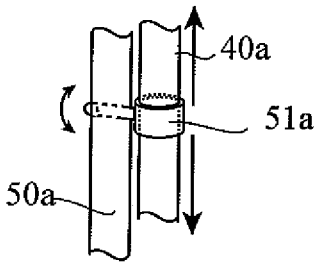

Please refer to FIG. 10 and FIGS. 10A to 10C for the folding chair 1*a* according to a second embodiment of the present invention. In this embodiment, the seat 10, the interlinking device 20, and the back 30 are quite similar to those in the first embodiment. The major difference between this embodiment and the first embodiment is that the front leg 50*a* and the rear leg 40*a* are not U-shaped, and both the front leg 50*a* and the rear leg 40*a* comprise bent parts 42*a*, 52*a*, which allow the folding chair 1*a* to stand more steadily than the folding chair 1 of the first embodiment on a surface 99 in the folded state S2. The purpose of the bent parts 42*a*, 52*a* is to provide supportive structures on the front leg 50*a* and the rear leg 40*a* for allowing the folding chair 1*a* to stand without external support in the folded state S2. It should be noted that the shape and design of the bent parts 42*a*, 52*a* are not restricted to the above-mentioned embodiments as long as they are able to support the folding chair 1*a* to stand. The rear leg 40*a* and the front leg 50*a* can comprise the bent parts 42*a*, 52*a* simultaneously or separately. In addition, extra components can also be attached to the front leg 50*a* or the rear leg 40*a* to form supportive structures to support the folding chair 1*a* effectively without the bent parts 42*a*, 52*a*. On the other hand, the handhold portion 33*a* is a protrusion on the back 30, and the leg coupling member 51*a* is a ring in this embodiment, which allows the leg coupling member 51*a* to slide along the rear leg 40*a* (FIG. 10C). The leg guiding member 24*a* connects the actuating members 21 and the rear leg 40*a* in this embodiment.

Figure 11:
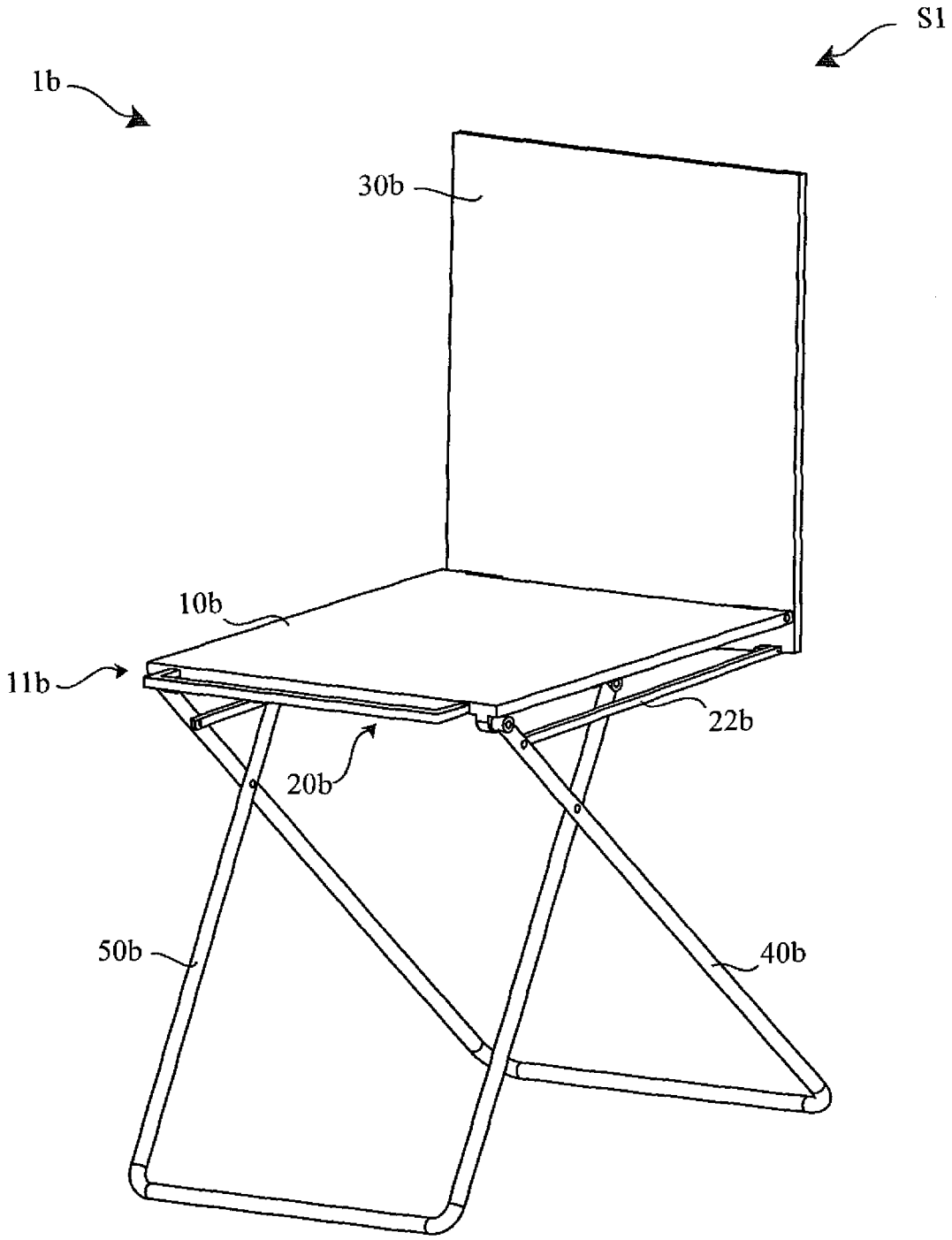
FIG. 11 provides a perspective view of the unfolded state and the folded state of the folding chair according to a third embodiment of the present invention.

Please refer to FIG. 11 for a folding chair 1*b* according to a third embodiment of the present invention. The major difference between this embodiment and the first and second embodiments is that there is no opening 14 in the front end 11*b* of the seat 10*b* as in the first embodiment, there are no leg guiding members 24, 24*a* in the interlinking device 20*b*, and there is no leg sliding portion 41 as in the first and second embodiments. The linking mechanism 22*b* connects the back lower end 32*b* of the back 30*b* and the rear leg 40*b*. Unlike that of the first embodiment, the linking mechanism 22*b* is hidden underneath the seat 10*b*, which makes it less likely to be touched by users when they are sitting. In addition, there is no handhold portion 33 in the back 30*b* as in the first embodiment, and also there are no bent parts 42*a*, 52*a* in the front leg 50*b* and the rear leg 40*b* as in the second embodiment. Although the lack of the handhold portion 33 may cause some inconvenience to the user in grasping the back, the user can still hold the back 30*b* directly to move or operate the folding chair 1*b*. In addition, it is not easy for the folding chair 1*b* to stand without external support in the folded state S2 without having the bent parts 42*a*, 52*a*. However, the lack of the bent parts 42*a*, 52*a* will not affect the folding and unfolding functions of the folding chair 1*b*.

Figure 12:
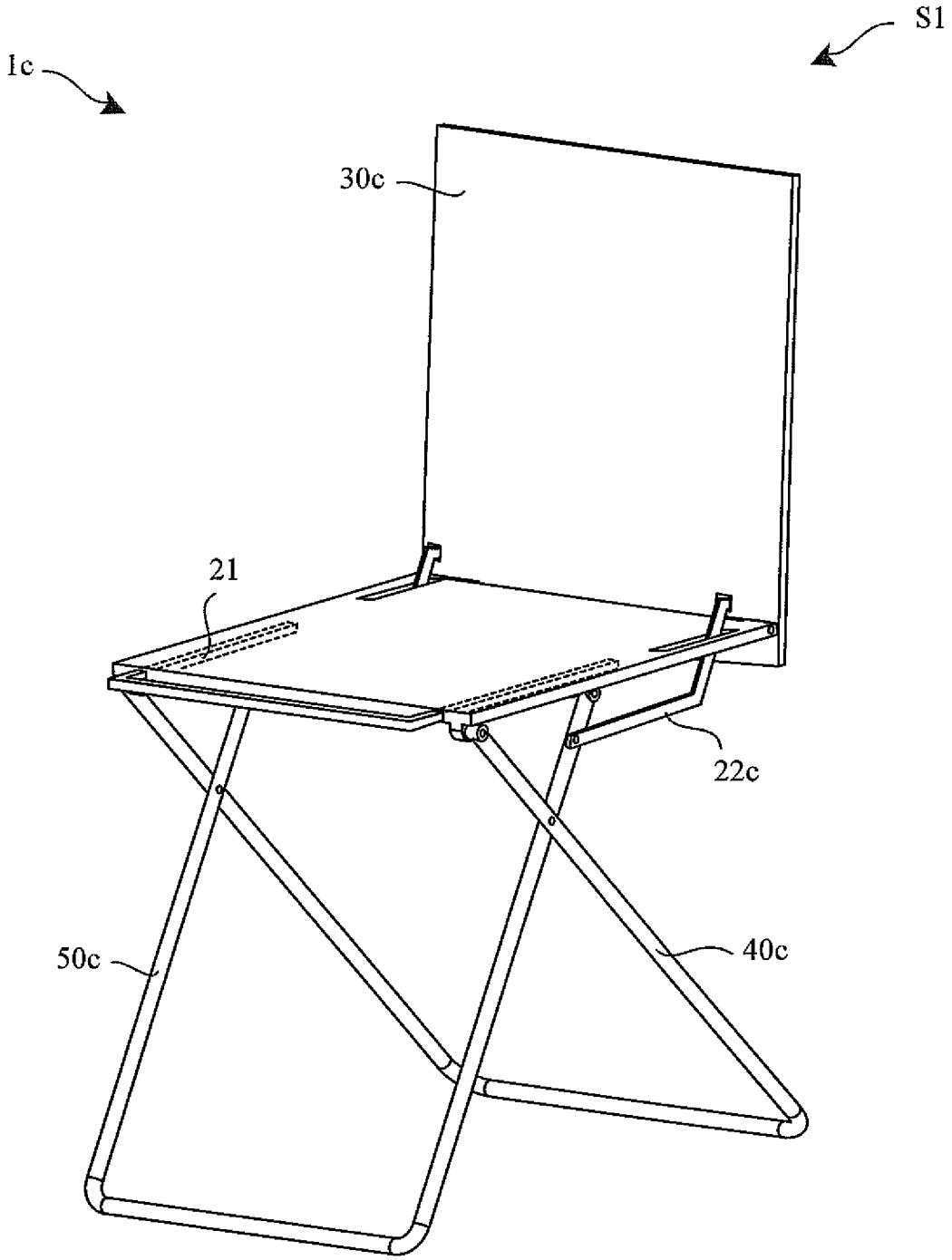
FIG. 12 provides a perspective view of the unfolded state of the folding chair according to a fourth embodiment of the present invention.

Please refer to FIG. 12 for the folding chair 1*c* according to a fourth embodiment of the present invention. The major difference between this embodiment and the third embodiment is that the linking mechanism 22*c* is connected to the back 30*c* and the front leg 50*c*. It should be noted that the back 30*c* could also be connected simultaneously or individually to the actuating members 21, the rear leg 40*c*, and the front leg 50*c* to accomplish the folding or unfolding process.

Figure 13:
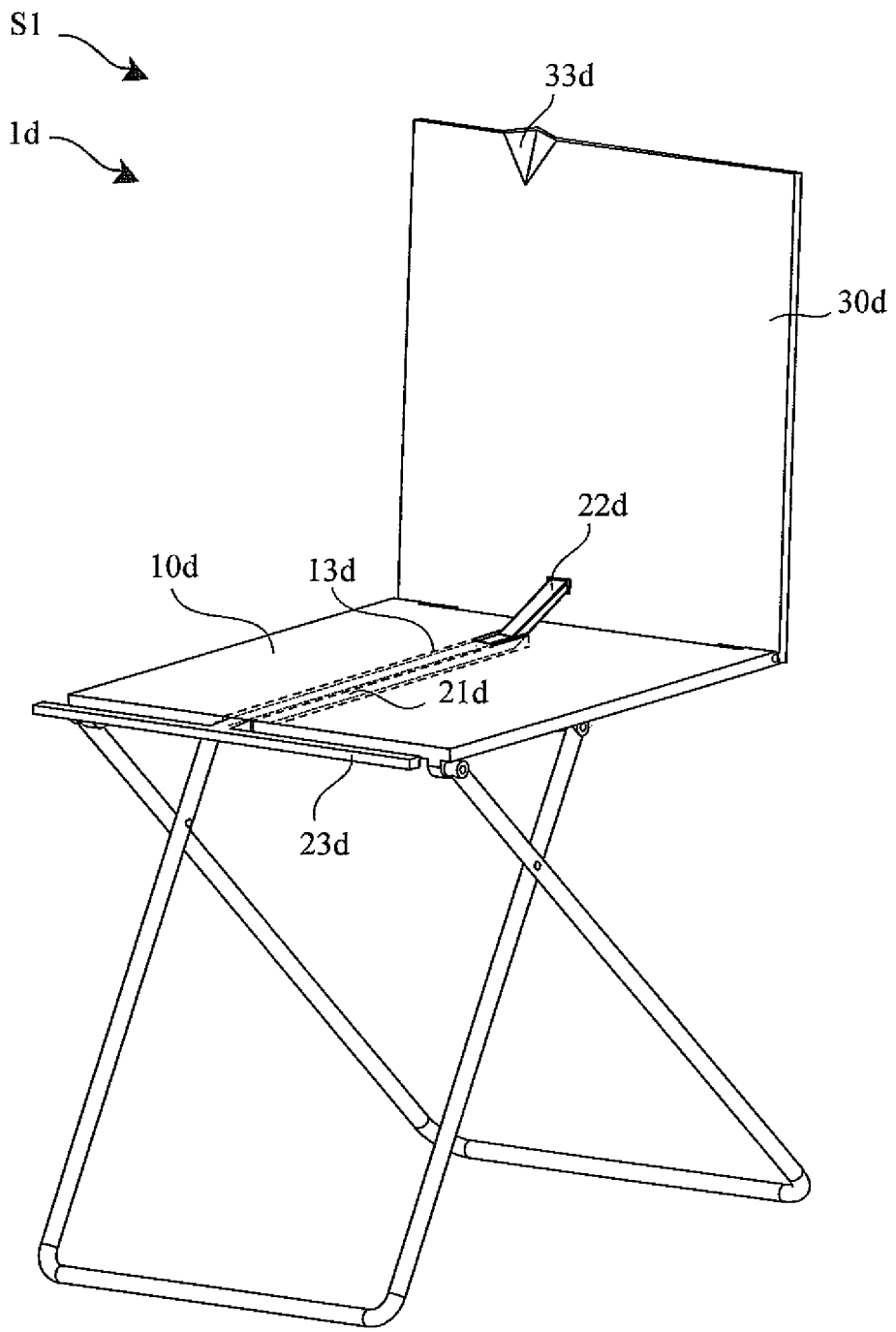
FIG. 13 provides a perspective view of the unfolded state of the folding chair according to a fifth embodiment of the present invention.

Please refer to FIG. 13 for the folding chair 1*d* according to a fifth embodiment of the present invention. The major difference between this embodiment and the third embodiment is that there is only one guiding portion 13*d* in the seat 10*d*, there is also only one actuating member 21*d* and one linking mechanism 22*d*, and the initial activating member 23*d* is T-shaped. In addition, the handhold portion 33*d* in this embodiment is a bent portion of the back 30*d*.

Figure 14:
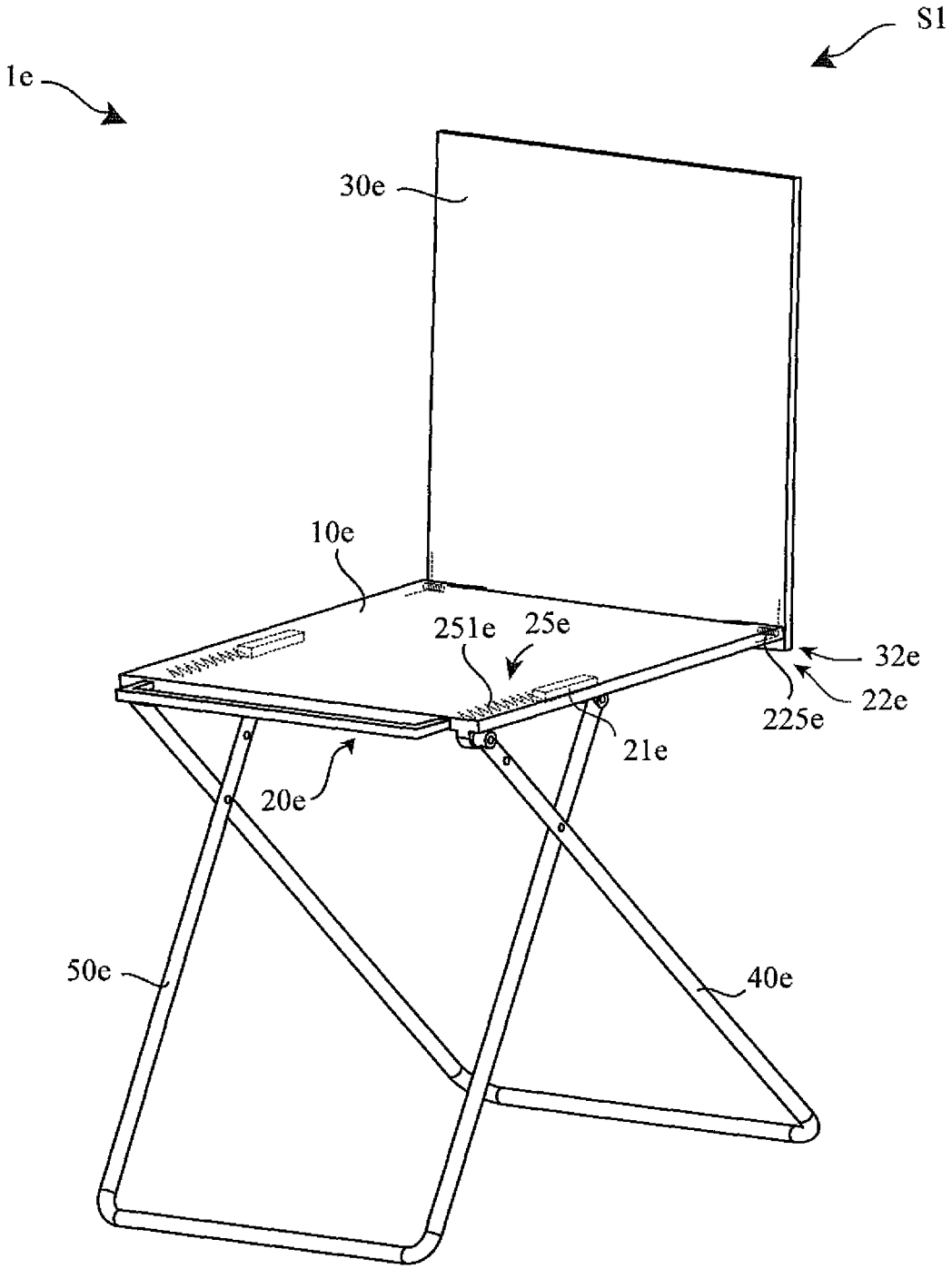
FIG. 14 and FIG. 14A provide perspective views of the unfolded state and the folded state of the folding chair according to a sixth embodiment of the present invention.
Figure 14A:
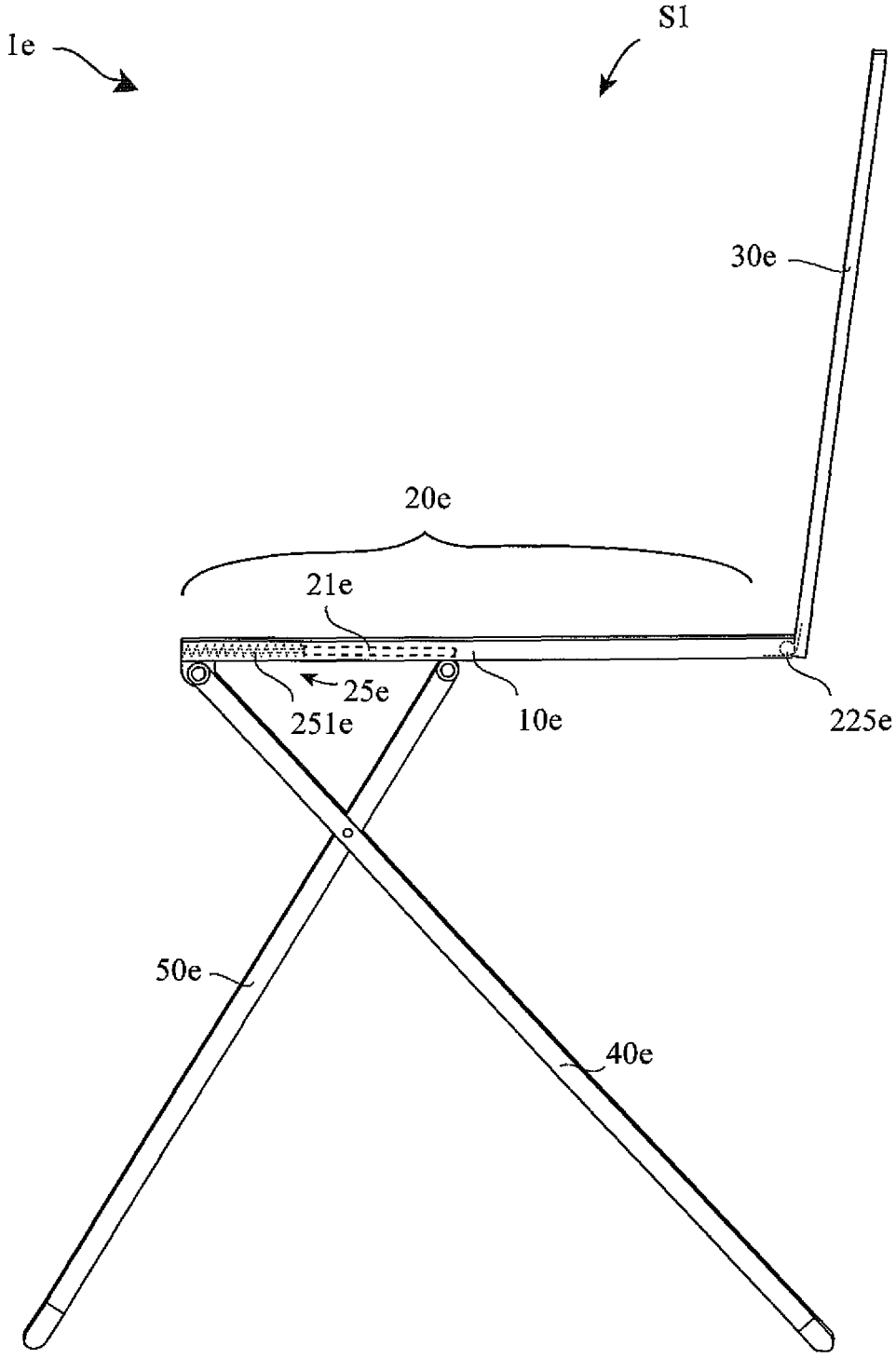

Please refer to FIG. 14 and FIG. 14A for the folding chair 1*e* according to a sixth embodiment of the present invention. The major difference between this embodiment and the third and fourth embodiments is that the linking mechanism 22*e* comprises an elastic member 225*e*, which is a torsion spring in this embodiment. The elastic member 225*e* is coupled to the seat 10*e* and the back lower end 32*e* of the back 30*e*. When the folding chair 1*e* transitions from the unfolded state S1 to the folded state S2, the elastic member 225*e* will drive the back 30*e* to rotate toward the seat 10*e* and cause the folding chair 1*e* to fold. Additionally, the interlinking device 20*e* further comprises an assisted actuating member 25*e*, which comprises an elastic member 251*e* in this embodiment, and the elastic member 251*e* is a compression spring. When the folding chair 1*e* transitions from the folded state S2 to the unfolded state S1, the elastic member 251*e* can unfold the rear leg 40*e* and the front leg 50*e* directly or drive the actuating members 21*e* to unfold the rear leg 40*e* and cause the front leg 50*e* to be expanded and thereby cause the folding chair 1*e* to unfold. The assisted actuating member 25*e* can be not only the type of elastic member 251*e* in this embodiment but also can be other types of elastic members a motor, or an electromagnetic, hydraulic pressure, pneumatic pressure, or other device that can directly or indirectly cause the back 30*e*, the seat 10*e*, the rear leg 40*e*, and the front leg 50*e*, to unfold or fold, and can be disposed at the seat 10*e*, the back 30*e*, the interlinking device 20*e*, the actuating members 21*e*, the rear leg 40*e*, or the front leg 50*e* such that the folding chair 1*e* can be folded and unfolded.

Figure 15:
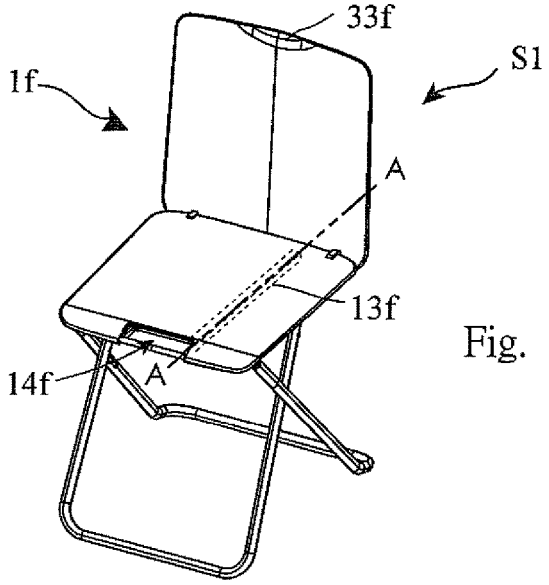
Figure 15A:
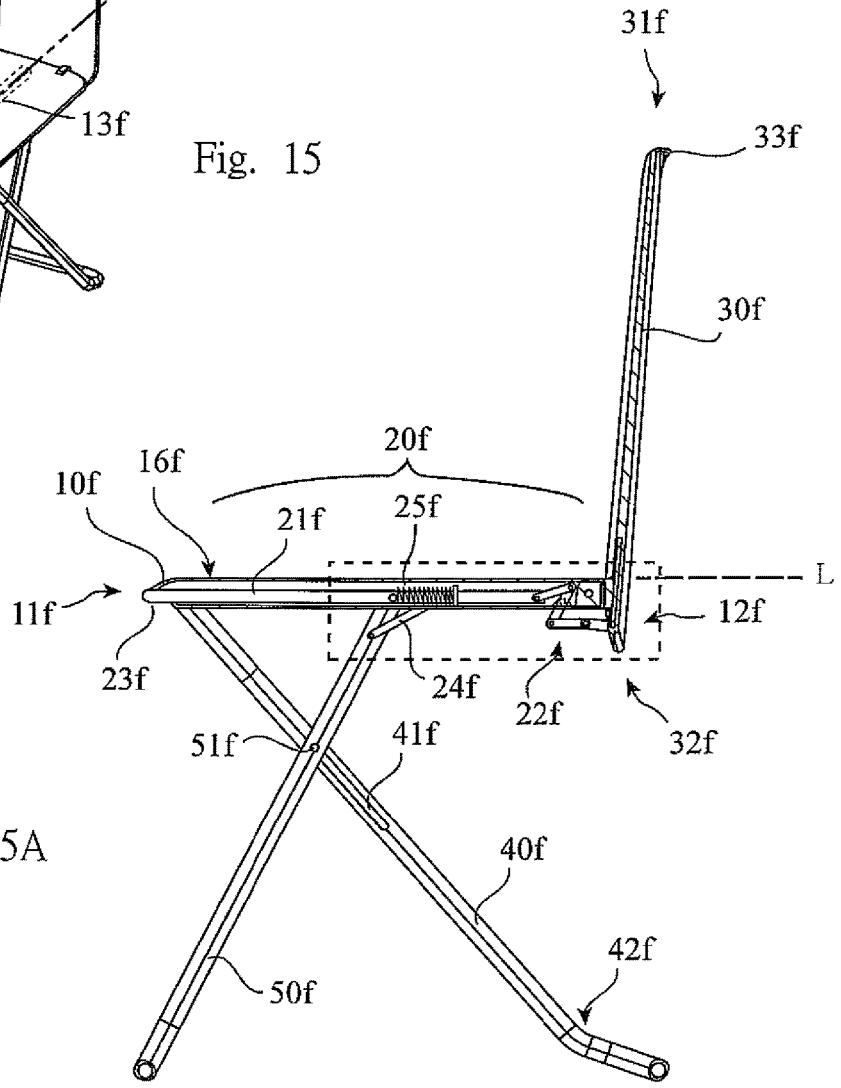
Figure 15B:
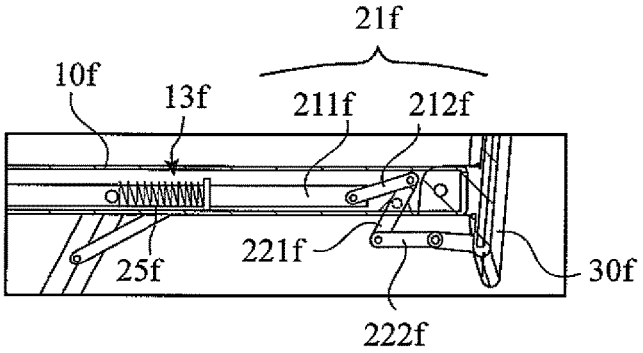
Figure 15C:
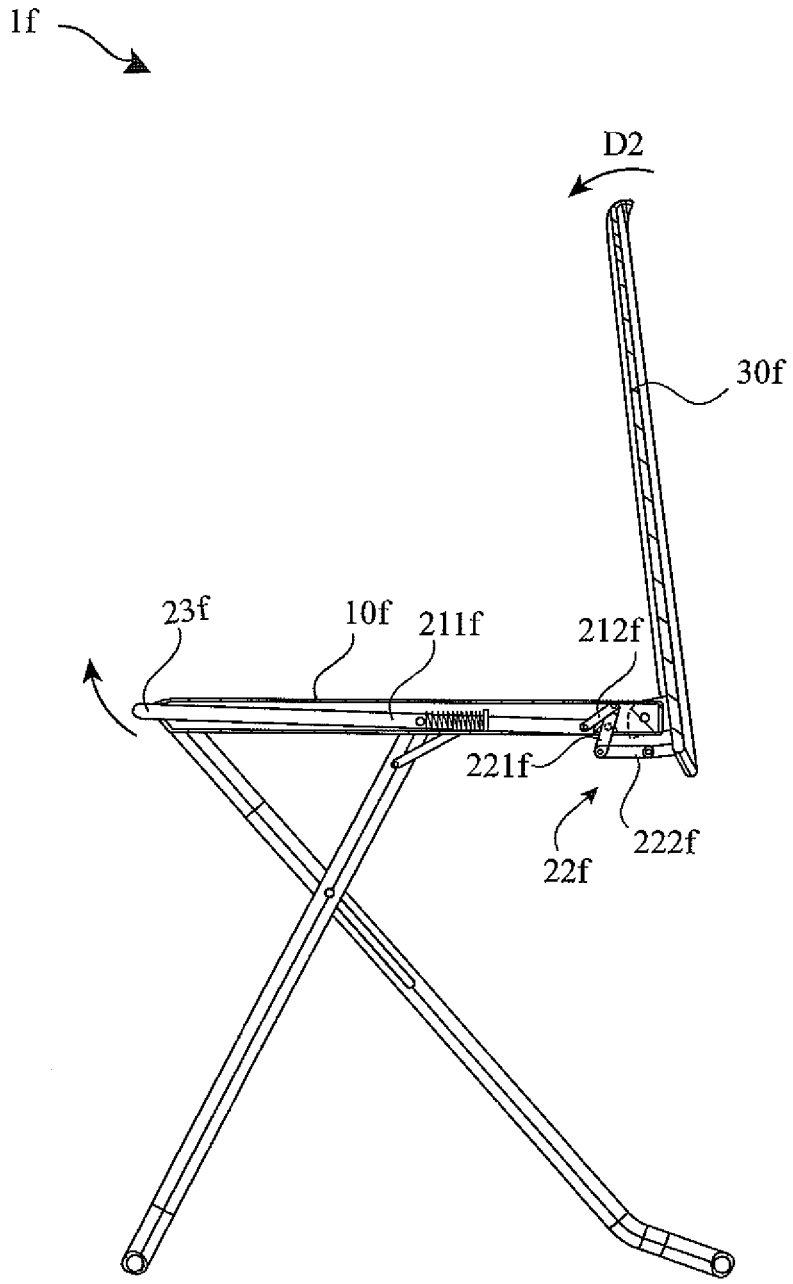
Figure 15G:
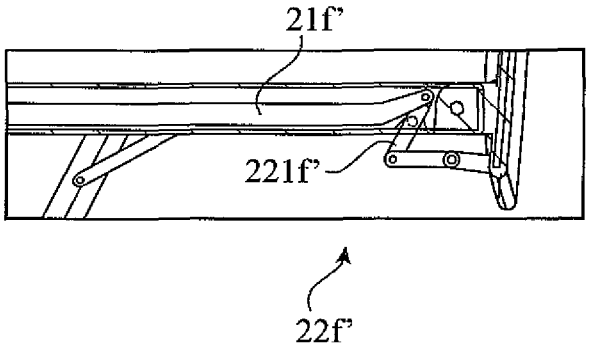
Figure 15H:
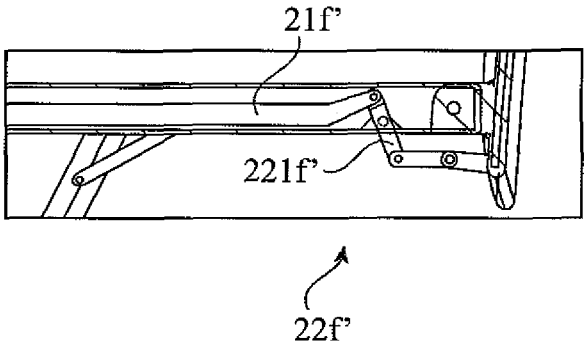
Figure 15I:
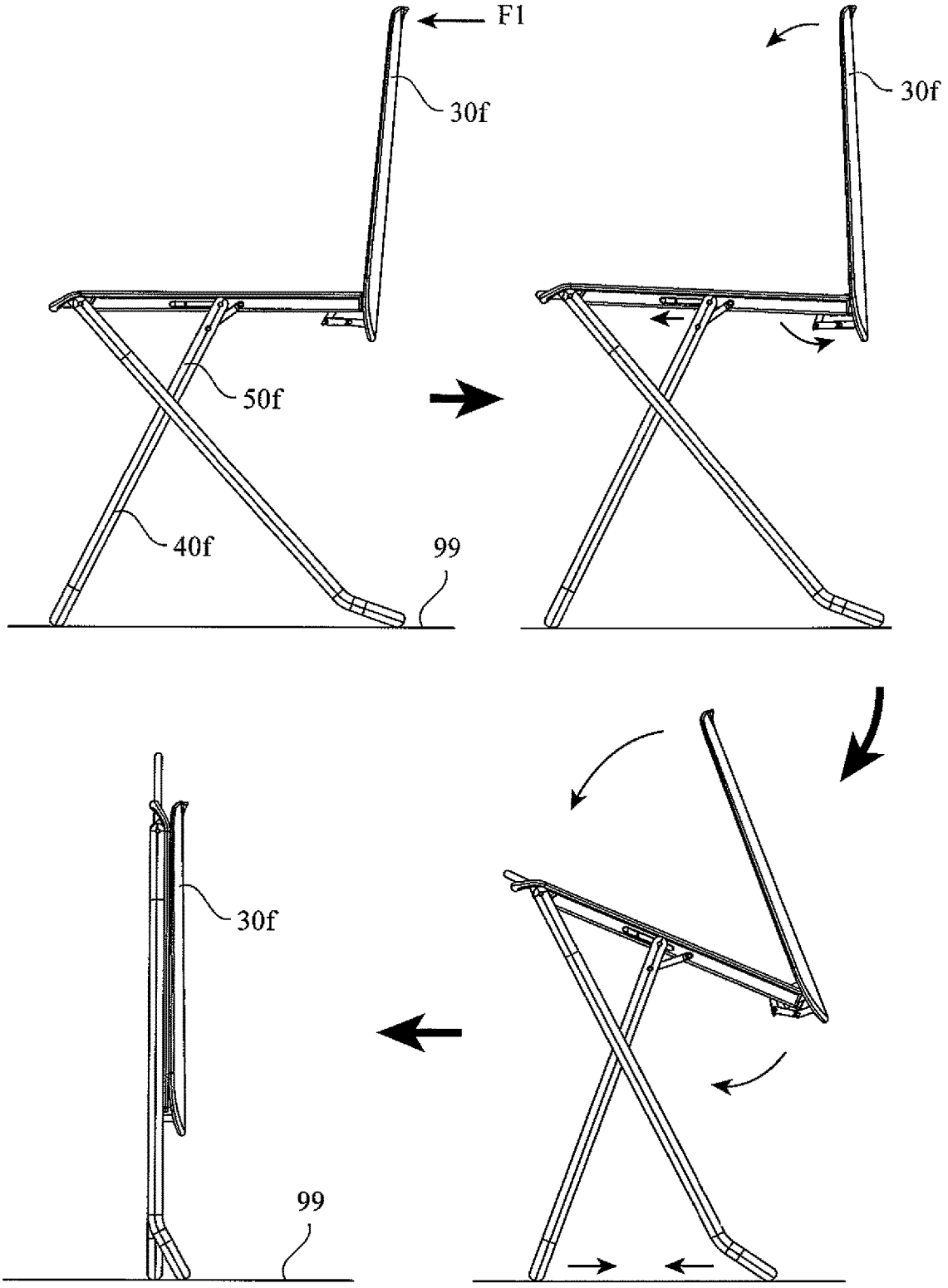
FIG. 15I and FIG. 15J provide schematic drawings showing the transition between the folded state and the unfolded state of the folding chair according to the seventh embodiment of the present invention.
Figure 15J:
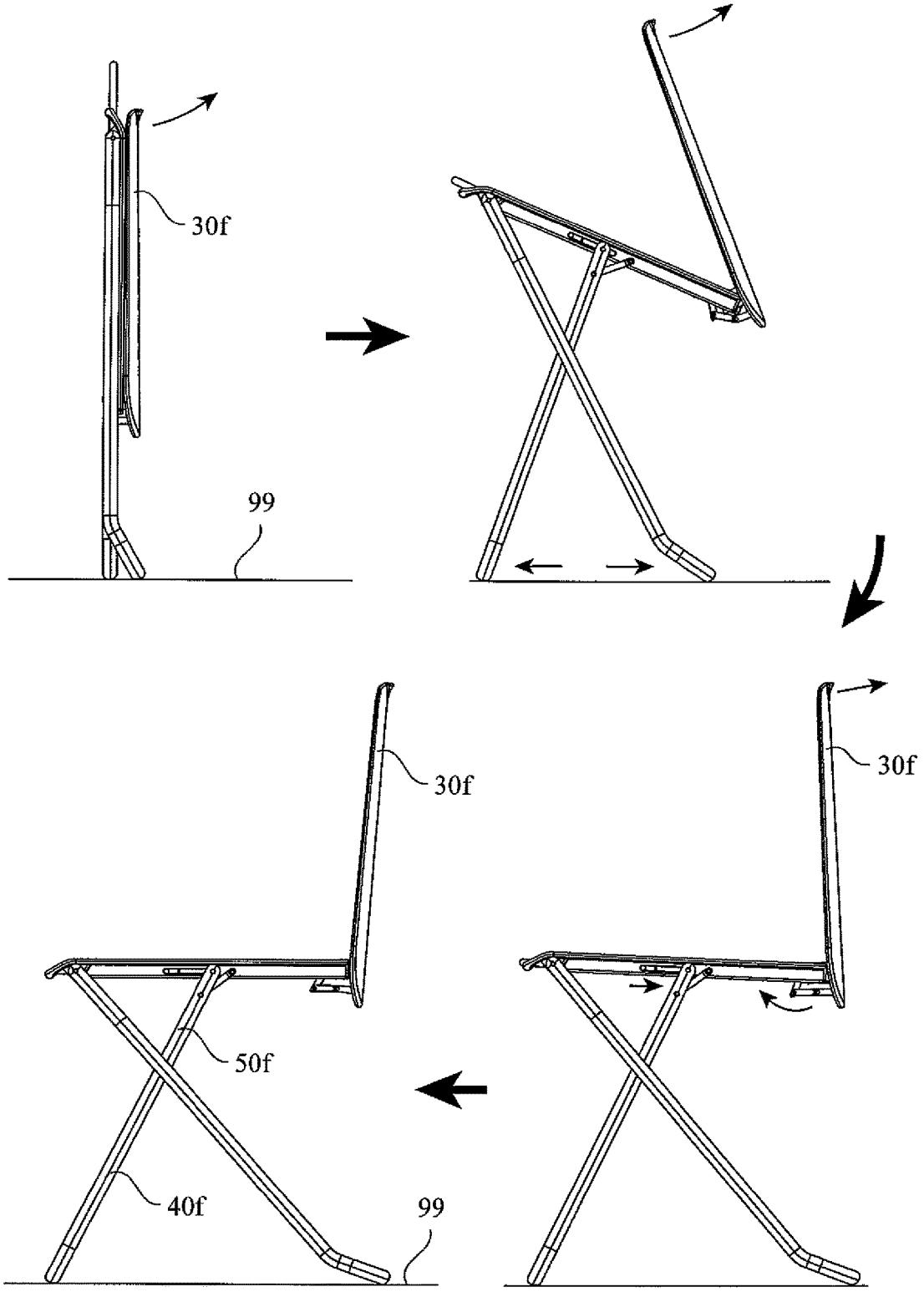

Please refer to FIG. 15 and FIG. 15A to 15J for the folding chair 1*f* according to a seventh embodiment of the present invention. The folding chair 1*f* comprises a seat 10*f*, an interlinking device 20*f*, a back 30*f*, a rear leg 40*f*, and a front leg 50*f*. The seat 10*f* comprises a front end 11*f*, a rear end 12*f*, a pair of guiding portions 13*f*, and a top surface 16*f*. In this embodiment, the guiding portions 13*f* are a pair of long grooves, and the front end 11*f* comprises an opening 14*f*. The back 30*f* comprises an upper end 31*f*, a back lower end 32*f* and a handhold portion 33*f*. The back lower end 32*f* refers to a lower portion of the back 30 that is lower than the top surface 16 in the unfolded state S1; i.e., the portion lower than the extended plane L shown in FIG. 15A. The interlinking device 20*f* comprises a pair of actuating members 21*f*, a pair of linking mechanisms 22*f*, an initial activating member 23*f* and a pair of leg guiding members 24*f*. The actuating members 21*f* are a pair of movable long rods that are able to slide in this embodiment. The rear leg 40*f* comprises a pair of leg sliding portions 41*f* and a bent part 42*f*. The front leg 50*f* comprises a pair of leg coupling members 51*f*. The linking structure among the seat 10*f*, the guiding portions 13*f*, the interlinking device 20*f*, the actuating members 21*f*, the linking mechanisms 22*f*, the initial activating member 23*f*, the leg guiding members 24*f*, the back 30*f*, the rear leg 40*f*, the leg sliding portions 41*f*, the front leg 50*f*, and the leg coupling members 51*f* are identical to those of the first embodiment. In addition, the folding chair 1*f* can stand on a surface 99 by itself in the unfolded state S1, the folded state S2, and the transition state between the unfolded state S1 and the folded state S2 due to the support provided by the front leg 50*f* and the rear leg 40*f*. The major difference between this embodiment and the first, the fourth, and the fifth embodiments is that the linking mechanism 22*f* is coupled to the back lower end 32*f* of the back 30*f*. The suggested position to dispose the linking mechanism 22*f* is close to the center of the seat 10*f*; i.e., away from the two sides, such as the location shown in the A-A cross-sectional line in FIG. 15. There are several advantages of coupling the linking mechanism 22*f* to the back lower end 32*f*. First, the linking mechanism 22*f* is not exposed above the top surface 16, which reduces the chance that users will directly touch the linking mechanism 22*f* in the unfolded state S1 when the user is sitting on the chair, so the service life of the mechanism will be extended and the chair will be more durable. Furthermore, the risk of causing injury to the user is reduced when the user is operating the folding chair 1*f* or sitting on it. Second, it is more comfortable for users to sit on the chair without contacting the mechanism because the back 30*f* is a complete surface devoid of hollow spaces for accommodating mechanisms above the seat 10. Furthermore, the linking mechanism 22*f* retracts into the seat 10*f* (FIG. 15F) in the folded state S2, which makes the folding chair 1*f* slim and flat in the folded state S2. Finally, the appearance is simpler and more stylish in both the unfolded state S1 and in the folded state S2. In order to connect the linking mechanism 22*f* to the back lower end 32*f* to hide and minimize the mechanism, each of the linking mechanisms 22*f* further comprises a rotary member 221*f* and a back coupling member 222*f* in this embodiment. The rotary member 221*f* and the back coupling member 222*f* are linkages in this embodiment, wherein the rotary member 221*f* is pivotally coupled to the seat 10*f* and the actuating members 21*f* pivotally connect to the rotary member 221*f*. The back coupling member 222*f* connects the rotary member 221*f* and the back 30*f*. The folding chair 1*f* can stand without external support on a surface 99 in the unfolded state S1, the folded state S2, and the transition state between the unfolded state S1 and the folded state S2. By employing the above structure, a user can actuate the folding process easily with a single hand by applying a force F1 on the back 30*f*, and the folding chair 1*f* will then transition from the unfolded state S1 into the folded state S2 by itself smoothly (FIG. 15I). Conversely, the user can easily unfold the folding chair 1*f* by pulling on the back 30*f* with a single hand in one continuous action (FIG. 15J).

Other examples also show how the linking mechanisms 22*b*, 22*v* are hidden underneath the seat 10*b*, 10*v* by connecting the linking mechanisms 22*b*, 22*v* to the back lower end 32*b*, 32*f* in different ways, such as the third embodiment and the following eighth embodiment.

Additionally, similar to the first embodiment, the current embodiment also provides another option to operate the folding chair 1*f* with a single hand by pushing or pulling the initial activating member 23*f*. However, in this embodiment, each of the actuating members 21*f* further comprises a main actuating member 211*f* and a secondary actuating member 212*f* (FIG. B), and the main actuating member 211*f* is coupled to the rotary member 221*f* by the secondary actuating member 212*f*.

When a user chooses to fold the chair by operating the initial activating member 23*f* and pulls the initial activating member 23*f*, the initial activating member 23*f* will actuate the main actuating member 211*f* and the secondary actuating member 212*f* of the actuating member 21*f*. Subsequently, the secondary actuating member 212*f* actuates the rotary member 221*f* and the back coupling member 222*f* of the linking mechanism 22*f*. Then, the linking mechanism 22*f* rotates the back 30*f*, which causes the upper end 31*f* of the back 30*f* to rotate toward the front end 11*f* of the seat 10*f* along the counterclockwise folding direction D2. This rotary action causes the folding chair 1*f* to begin transitioning from the unfolded state S1 to the folded state S2. The function of the secondary actuating member 212*f* is to cause the back 30*f* to rotate toward the counterclockwise folding direction D2 more easily than that in the first embodiment when the initial activating member 23*f* is slightly pulled and rotated (FIG. 15C). After that, the user can continue to pull the initial activating member 23*f* and lift up the folding chair 1*f* to cause the actuating members 21*f* to slide and actuate the folding function of the folding chair 1*f*. This design makes it easier for users to transition the folding chair 1*f* from the unfolded state S1 into the folded state 52 than is possible in the first embodiment. However, even without the secondary actuating member 212*f*, the actuating members 21*f* can still pivotally connect to the rotary member 221*f* of the linking mechanism 22*f'* directly (FIG. 15G, FIG. 15H), which will not affect any of the folding or unfolding functions. It should be noted that users can still fold or unfold the folding chair 1*f* by pushing or pulling on the back 30*f* even if the initial activating member 23*f* and the secondary actuating member 212*f* are omitted from this embodiment. In addition, the interlinking device 20*f* can further comprise assisted actuating members 25*f*, which are compression springs disposed between the actuating members 21*f* and the seat 10*f* in this embodiment. The assisted actuating members 25*f* are compressed in the unfolded state S1 (FIG. 15B). When the user pushes the back 30*f* or pulls the initial activating member 23*f* in the unfolded state S1, the assisted actuating members 25*f* will be released from the compressed state and push the actuating members 21*f* to move, which helps to actuate the folding process. Other than compression springs, the assisted actuating members 25*f* can also be tension springs, torsion springs, or other types of elastic members or mechanisms that can help to actuate the interlinking device 20*f*. Also, the assisted actuating members 25*f* can be disposed at different components or positions of the folding chair 1*f*. It should also be noted that the folding or unfolding function of the folding chair 1*f* can still work well even if the assisted actuating members 25*f* are omitted from this embodiment.

Moreover, the rotary member 221*f* further comprises a main rotary member 2211*f* and a secondary rotary member 2212*f* in this embodiment (FIG. 15F). The main rotary member 2211*f* and the secondary rotary member 2212*f* are a telescopic tube mechanism in this embodiment with the rotary member 221*f* being an extendable rod. It should be noted that similar to the fifth embodiment, there can be only a single linking mechanism 22*f* which consists of one rotary member 221*f* and one back coupling member 222*f*, only one actuating member 21*f*, and only one guiding portion 13*f* in this embodiment. In addition, both the rotary members 221*f* and the back coupling members 222*f* can consist of single or multiple components. Furthermore, other known techniques and mechanisms such as elastic members, telescopic members, and so on are applicable to the rotary member 221*f* to make its length adjustable.

Figure 16:
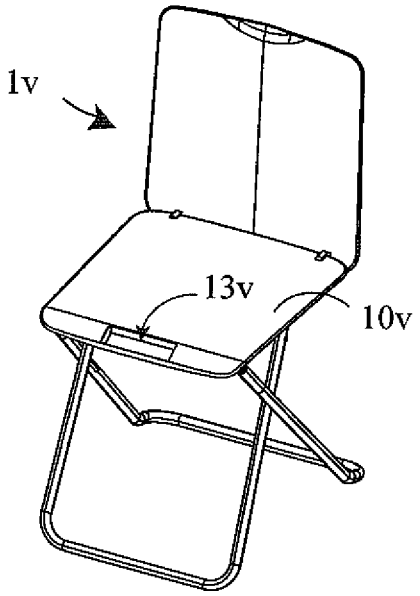
FIG. 16 and FIG. 16A provide perspective views and side views showing the unfolded state of the folding chair according to an eighth embodiment of the present invention.
Figure 16A:
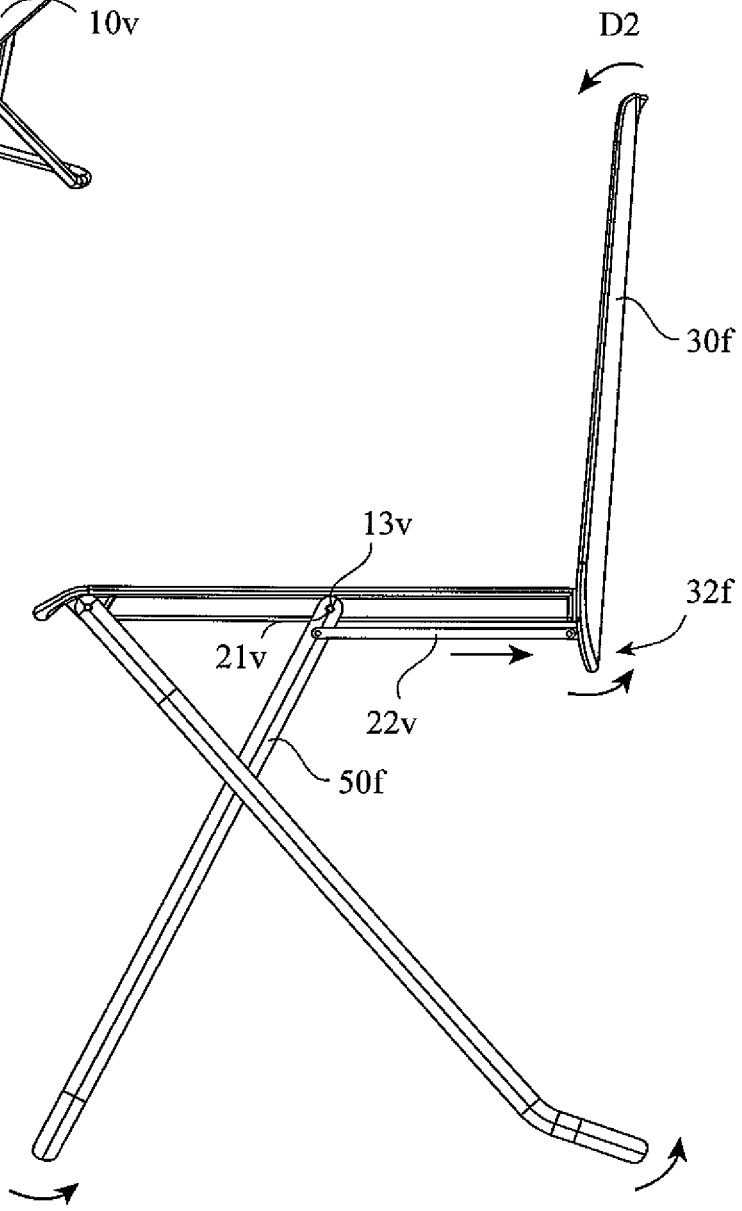

Please refer to FIG. 16 and FIG. 16A for the folding chair 1*v* according to an eighth embodiment of the present invention. The major difference between this embodiment and the seventh embodiment is that the guiding portion 13*v* is a hole, and the actuating member 21*f* is a shaft in this embodiment. The actuating member 21*f* can rotate in the guiding portion 13*v*. Additionally, the front leg 50*f*, the actuating member 21*v*, and the guiding portion are pivotally connected. The linking mechanism 22*v* connects the front leg 50*f* to the back lower end 32*f* of the back 30*f*. When the back 30*f* is pulled and rotated along the counterclockwise folding direction D2, the linking mechanism 22*v* actuates the front leg 50*f* and causes the folding chair 1*v* to begin to fold. In addition, in this embodiment, the initial activating member 23*v* is a hole, of a size that is suitable for handling, in the seat 10*v*. The initial activating member 23*v* is connected to the actuating member 21*v* by the seat 10*v*. After folding the folding chair 1*v*, users can move, transport, or hang the folding chair 1*v* by manipulating the initial activating member 23*v*.

Figure 17:
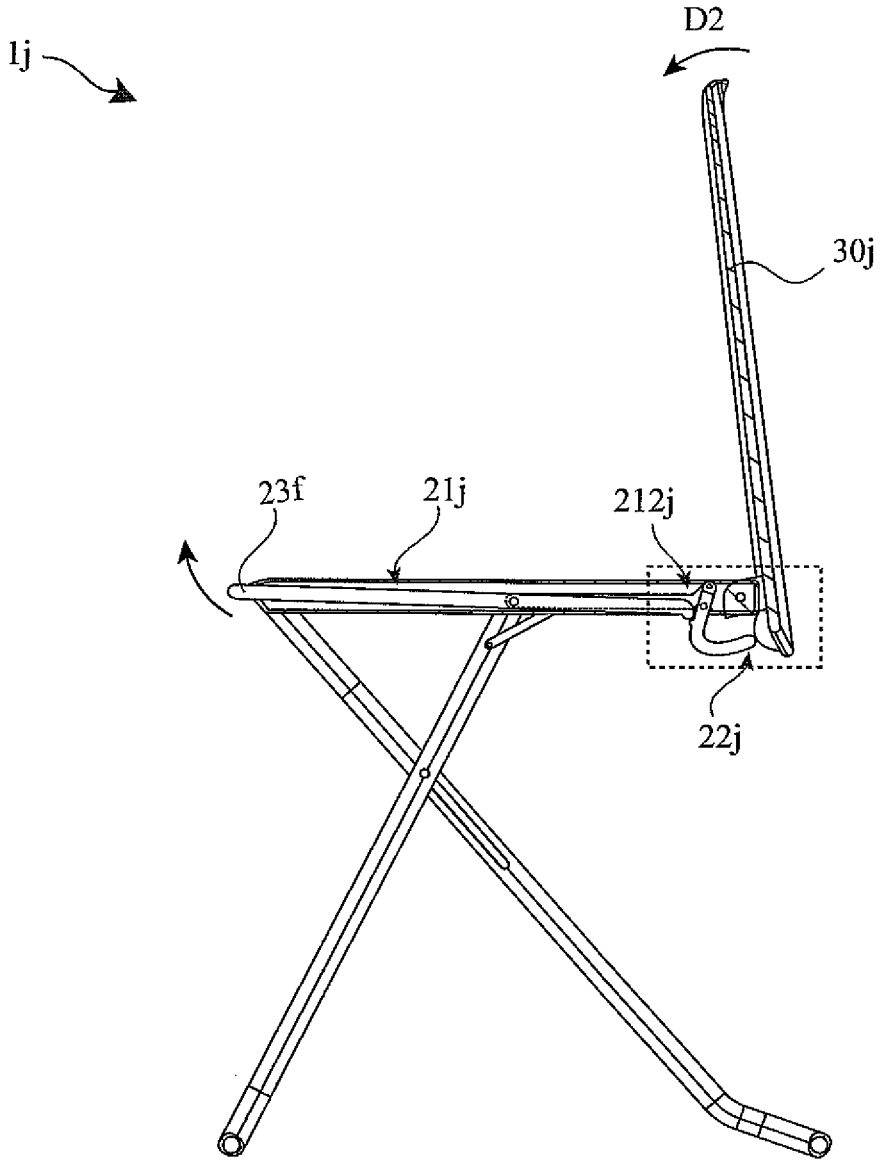
FIG. 17, FIG. 17A and FIG. 17B provide cross-sectional views and partial enlarged views showing the unfolded state of the folding chair according to a ninth embodiment of the present invention.
Figure 17A:
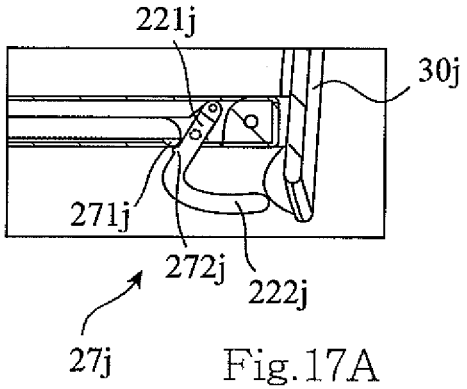
Figure 17B:
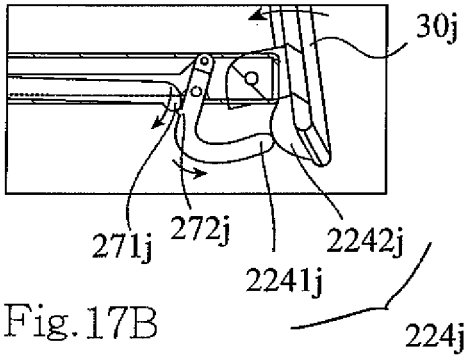

Please refer to FIG. 17, FIGS. 17A and 17B for the folding chair 1*j* according to a ninth embodiment of the present invention. The major difference between this embodiment and the seventh embodiment is that in this embodiment, the secondary actuating member 212*j* comprises a cam mechanism 27*j*. The cam mechanism 27*j* comprises a cam 271*j* and a follower 272*j*, the cam 271*j* is disposed at the end of the actuating members 21*j*, and the follower 272*j* is disposed at the rotary member 221*j*. The linking mechanism 22*j* comprises another cam mechanism 224*j*. The cam mechanism 224*j* comprises a cam 2241*j* and a follower 2242*j*, the cam 2241*j* is disposed at the end of the back coupling member 222*j*, and the follower 2242*j* is disposed at the back 30*j*. The back coupling member 222*j* is connected to the rotary member 221*j*. When the user pulls the initial activating member 23*f*, the cam 271*j* touches the follower 272*j* and pushes the rotary member 221*j*, and after that, the back coupling member 222*j* drives the back 30*j* to rotate. There are multiple ways to connect the actuating members 21*j* and the rotary member 221*j* and to connect the back coupling member 222*j* and the back 30*j*, which are not limited to a cam as long as the actuating members 21*j* can drive the rotary member 221*j* to rotate when it moves. Other methods such as gear or friction-driven mechanisms are also applicable.

Figure 18:
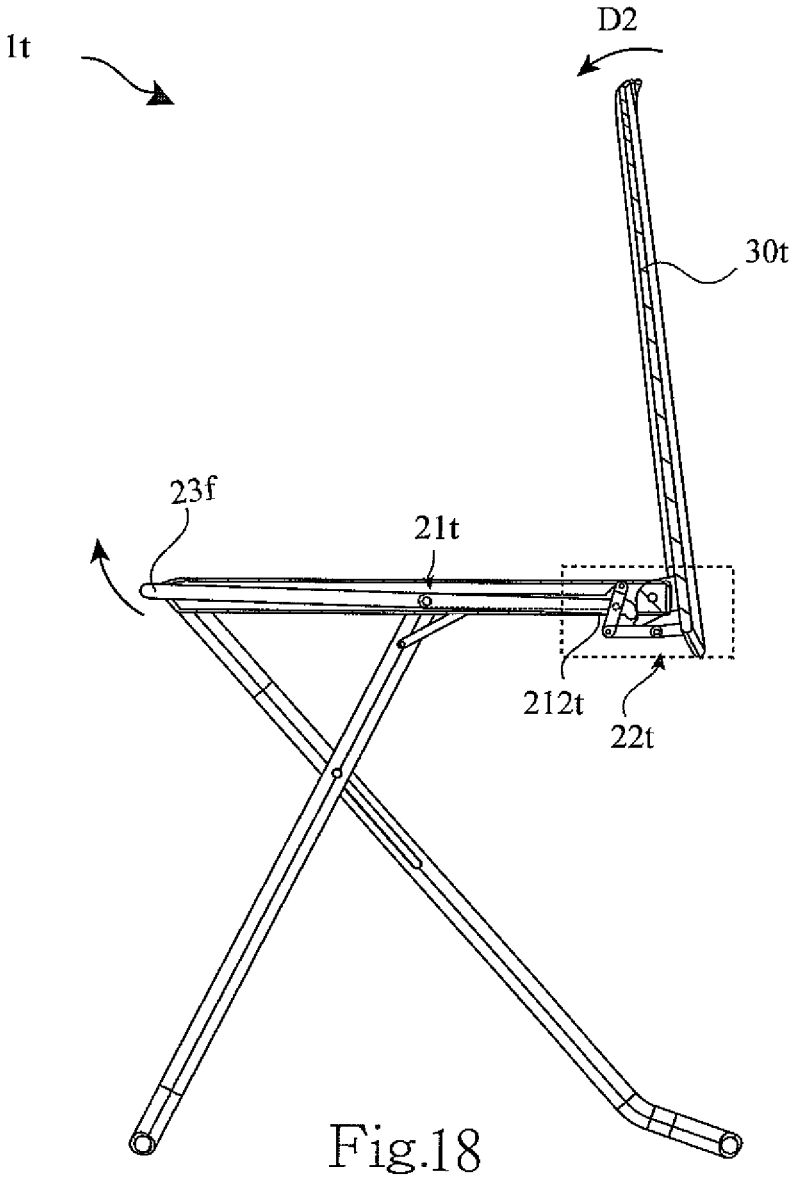
FIG. 18, FIG. 18A and FIG. 18B provide cross-sectional views and partial enlarged views showing the unfolded state of the folding chair according to a tenth embodiment of the present invention.
Figure 18A:
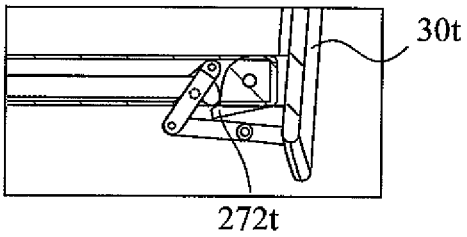
Figure 18B:
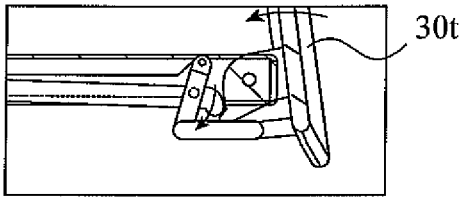

Please refer to FIG. 18, FIGS. 18A and 18B for the folding chair 1*t* according to a tenth embodiment of the present invention. The major difference between this embodiment and the ninth embodiment is that the follower 272*t* is disposed at the back 30*t*, and the linking mechanism 22*t* is quite similar to the seventh embodiment in this embodiment. When the user pulls the initial activating member 23*f*, the secondary actuating member 212*t* will rotate and drive the back 30*t* to rotate. There can be multiple connection methods between the actuating members 21*t* and the back 30*t*, which are not restricted to the above-mentioned embodiments. Other methods such as gear or friction-driven mechanisms are also applicable as long as the actuating members 21*t* can drive the back 30*t* to rotate when they move.

Figure 19:
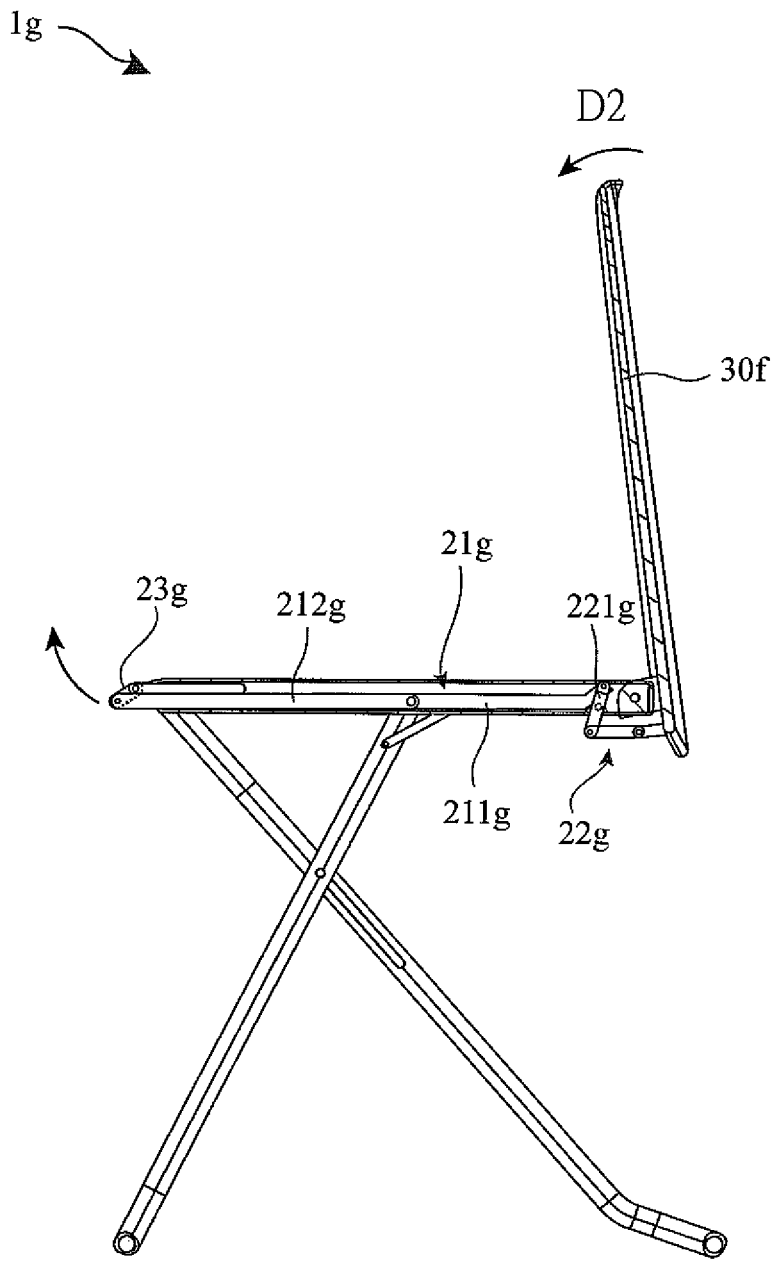
FIG. 19 provides a cross-sectional view of the unfolded state of the folding chair according to an eleventh embodiment of the present invention.

Please refer to FIG. 19 for the folding chair 1*g* according to an eleventh embodiment of the present invention. The major difference between this embodiment and the seventh embodiment is that the secondary actuating member 212*g* is coupled to the initial activating member 23*g* and to the main actuating member 211*g*. The main actuating member 211*g* is coupled to the rotary member 221*g* of the linking mechanism 22*g*. When the initial activating member 23*g* is pulled and starts to move, it will activate the actuating members 21*g* and the linking mechanism 22*g* to cause the back 30*f* to rotate along the counterclockwise folding direction D2.

Figure 20:
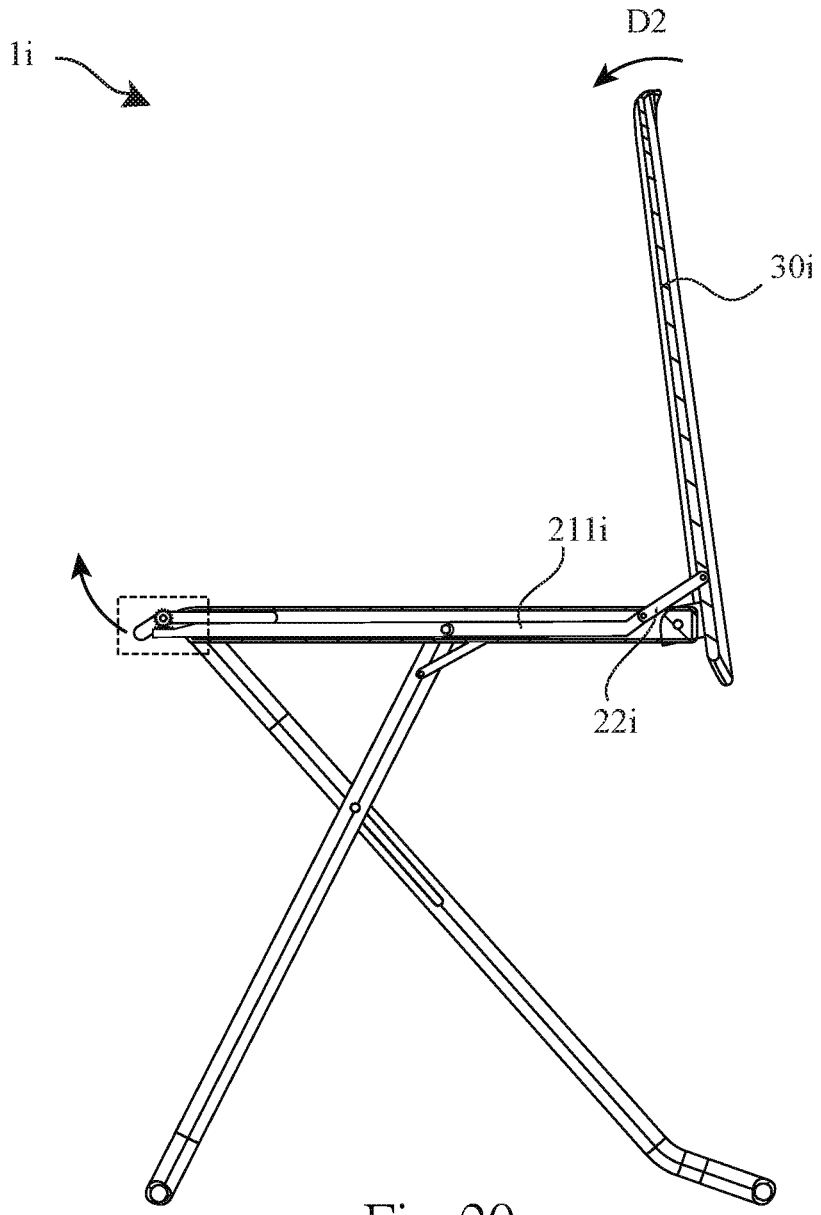
FIG. 20 and FIG. 20A provide cross-sectional views and partial enlarged views showing the unfolded state of the folding chair according to a twelfth embodiment of the present invention.
Figure 20A:
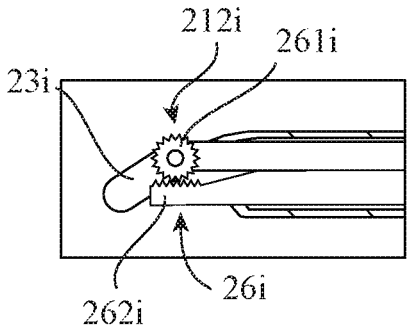

Please refer to FIG. 20 for the folding chair 1*i* according to a twelfth embodiment of the present invention. The major difference between this embodiment and the eleventh embodiment is that there is no rotary member 221*f* or back coupling member 222*f* in the linking mechanism 22*i* in this embodiment. The shape of the linking mechanism 22*i* in this embodiment is a connecting rod, which is coupled to the main actuating member 211*i* and to the back 30*i*. The secondary actuating member 212*i* in this embodiment comprises a gear set 26*i*, which comprises a first gear member 261*i* and a second gear member 262*i*. The first gear member 261*i* is disposed at the initial activating member 23*i*, and the second gear member 262*i* is disposed at the main actuating member 211*i* and engaged with the first gear member 261*i*. When the initial activating member 23*i* is pulled and starts to move, the main actuating member 211*i* will be activated.

Figure 21:
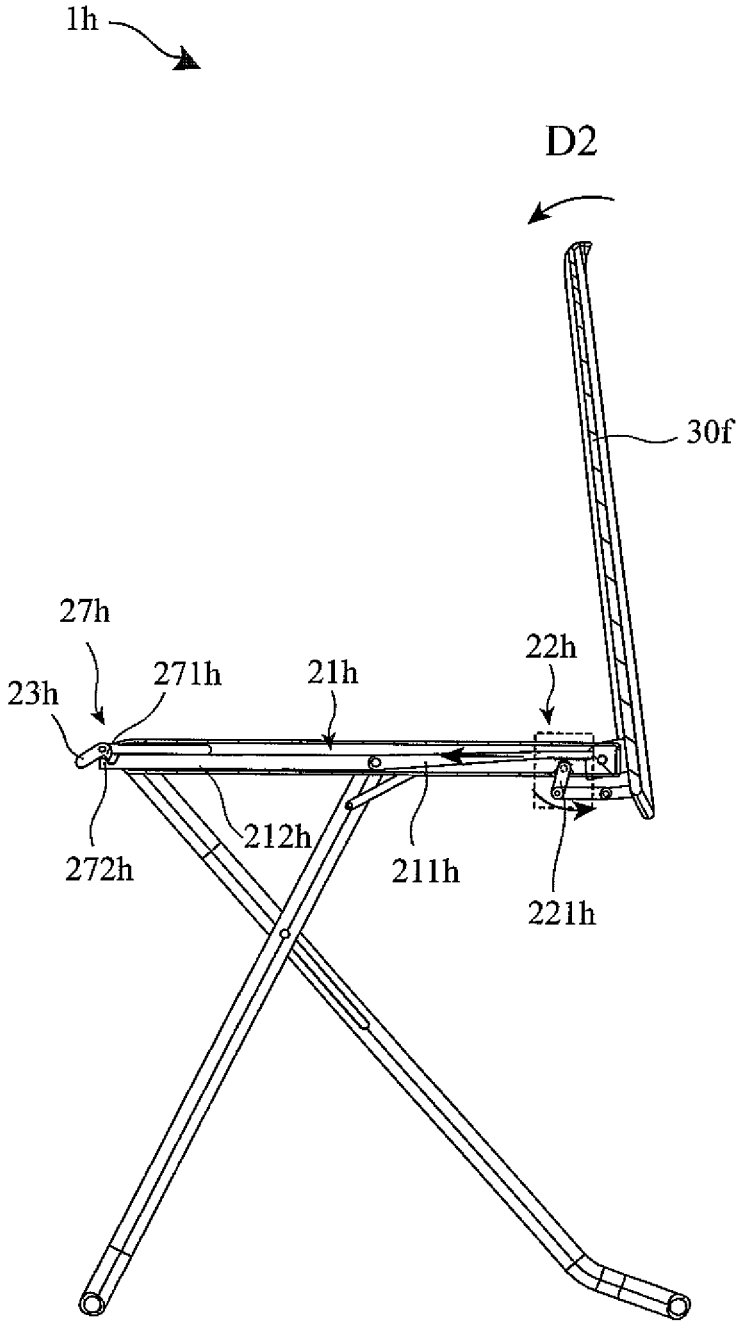
FIG. 21 and FIG. 21A provide cross-sectional views and partial enlarged views showing the unfolded state of the folding chair according to a thirteenth embodiment of the present invention.
Figure 21A:
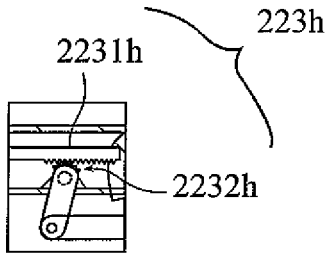

Please refer to FIGS. 21 and 21A for the folding chair 1*h* according to a thirteenth embodiment of the present invention. The major difference between this embodiment and the eleventh embodiment is that the linking mechanism 22*h* further comprises a gear set 223*h*. The gear set 223*h* comprises a first gear member 2231*h* and a second gear member 2232*h*. The first gear member 2231*h* is disposed at the end of the main actuating member 211*h*, and the second gear member 2232*h* is disposed at the rotary member 221*h*. The first gear member 2231*h* and the second gear member 2232*h* are engaged. Also, the secondary actuating member 212*h* comprises a cam mechanism 27*h*. The cam mechanism 27*h* comprises a cam 271*h* which is disposed at the initial activating member 23*h* and a follower 272*h* which is connected to the main actuating member 211*h*. When the initial activating member 23*h* is pulled, the main actuating member 211*h* is activated and drives the rotary member 221*h* and the back 30*f* to rotate. It should be noted that the first gear member 2231*h* and the second gear member 2232*h* can consist of one or multiple gear members. Also, multiple methods can be used to connect the actuating member 21*h* and the rotary member 221*h*, such as a friction-driven mechanism or a belt. Therefore, the method of connection is not restricted to the above-mentioned embodiments, as long as the actuating member 21*h* drives the rotary member 221*h* to rotate when it moves.

Figure 22:
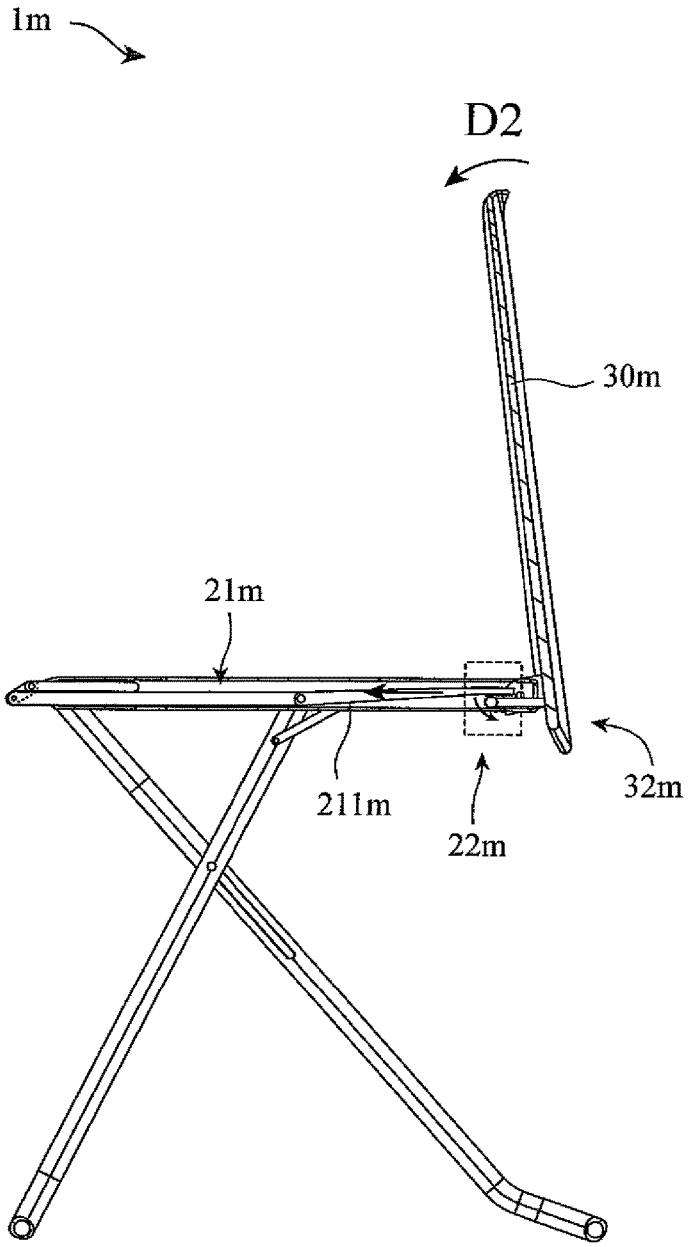
FIG. 22 and FIG. 22A provide cross-sectional views and partial enlarged views showing the unfolded state of the folding chair according to a fourteenth embodiment of the present invention.
Figure 22A:
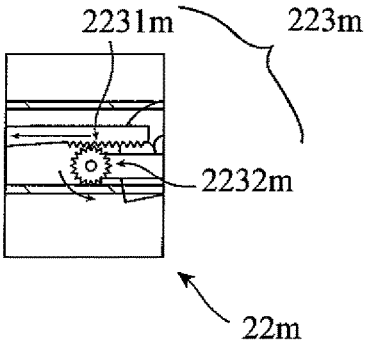

Please refer to FIGS. 22 and 22A for the folding chair 1*m* according to a fourteenth embodiment of the present invention. The major difference between this embodiment and the thirteenth embodiment is that there is no rotary member 221*f* or back coupling member 222*f* in the linking mechanism 22*m* in this embodiment. In this embodiment, the linking mechanism 22*m* comprises a gear set 223*m*. The gear set 223*m* comprises a first gear member 2231*m* which is disposed at the end of the main actuating member 211*m*, and a second gear member 2232*m* which is disposed at the back lower end 32*m* of the back 30*m*. The first gear member 2231*m* and the second gear member 2232*m* are engaged. When the main actuating member 211*m* moves, it drives the back 30*m* to rotate. Multiple connection methods can be used between the main actuating member 21*m* and the back 30*m*, and the connection method is not restricted to the above-mentioned embodiments. For example, a cam or friction between the main actuating members 21*m* and the back 30*m* are also applicable as long as when the main actuating member 211*m* moves, it drives the back 30*m* to rotate.

Figure 23:
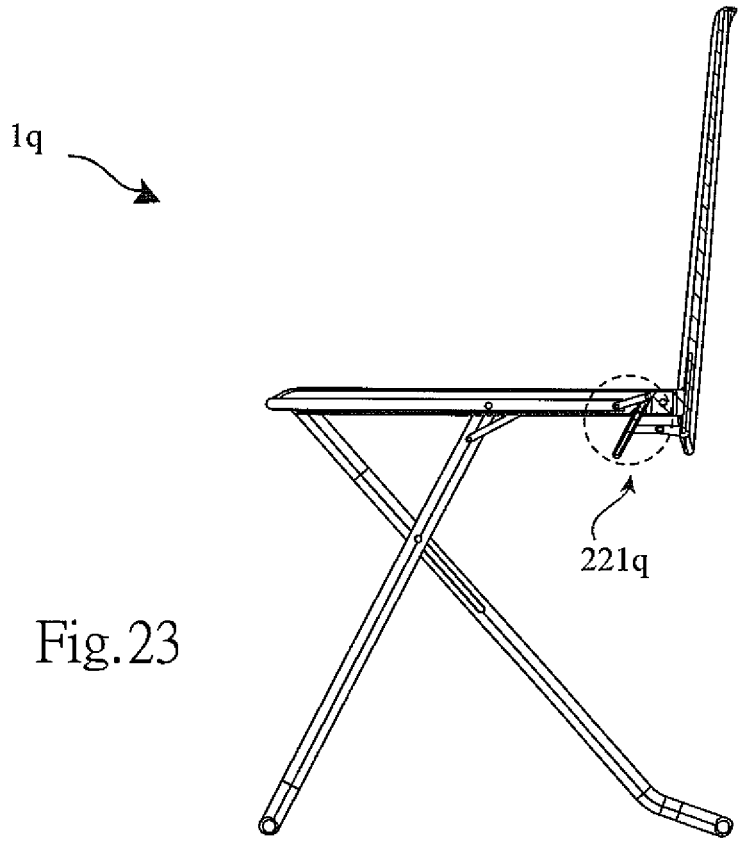
FIG. 23 provides a cross-sectional view of the unfolded state of the folding chair according to a fifteenth embodiment of the present invention.
Figure 23A:
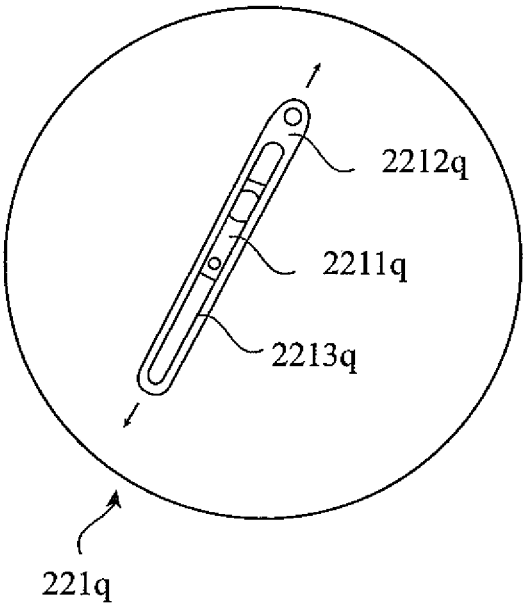
FIG. 23A and FIG. 23B are schematic drawings illustrating that the main rotary member and the secondary rotary member can relatively slide according to the fifteenth embodiment of the present invention.
Figure 23B:
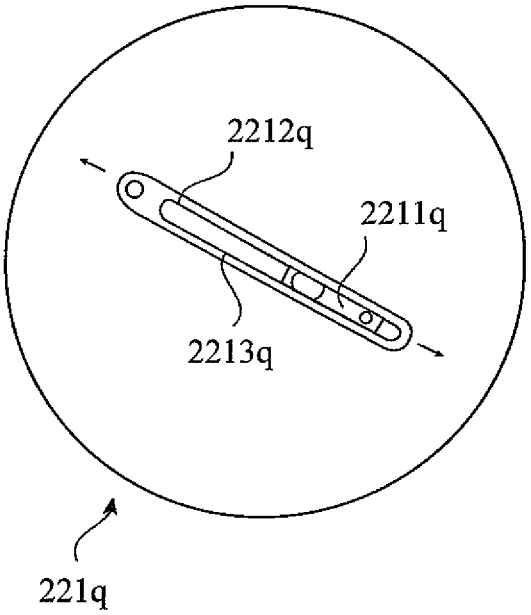

Please refer to FIG. 23 and FIG. 23A to B for the folding chair 1*q* according to a fifteenth embodiment of the present invention. The major difference between this embodiment and the seventh embodiment is that the secondary rotary member 2212*q* of the rotary member 221*q* comprises a slot 2213*q* in this embodiment. The main rotary member 2211*q* is coupled to the slot 2213*q* such that the secondary rotary member 2212*q* can slide relative to the main rotary member 2211*q* (FIG. 23B).

Figure 24:
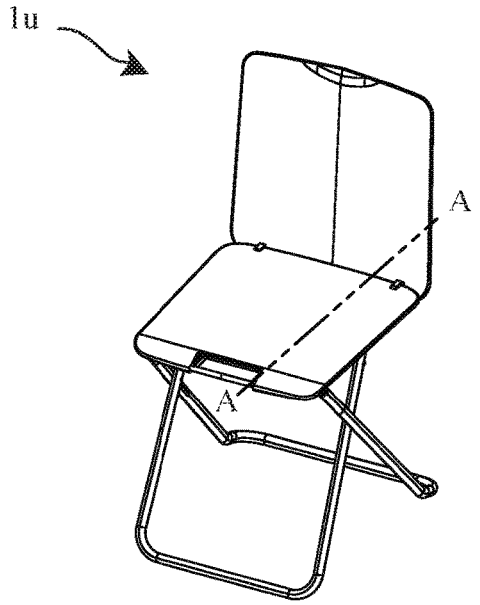
FIG. 24, FIG. 24A and FIG. 24B provide perspective views and cross-sectional views showing the unfolded state and the folded state of the folding chair according to a sixteenth embodiment of the present invention.
Figure 24A:
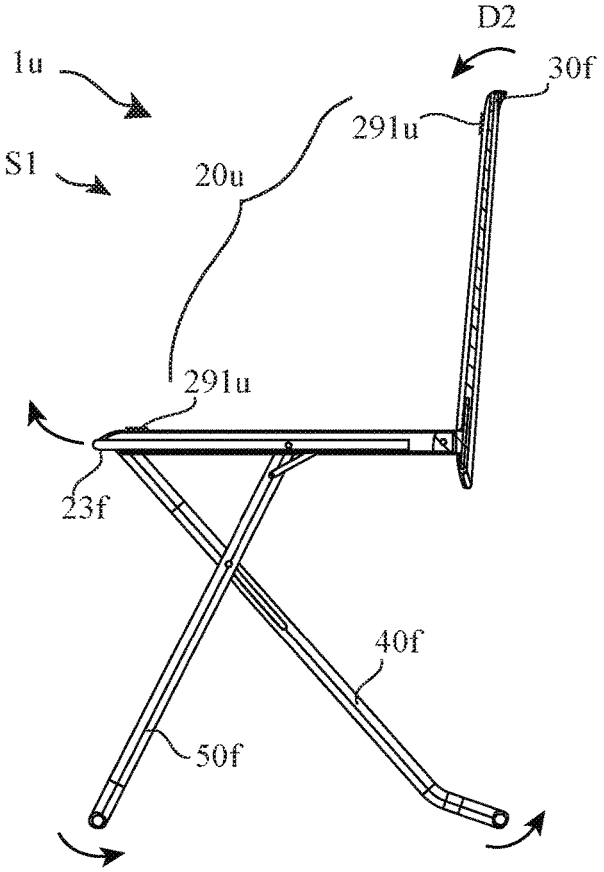
Figure 24B:
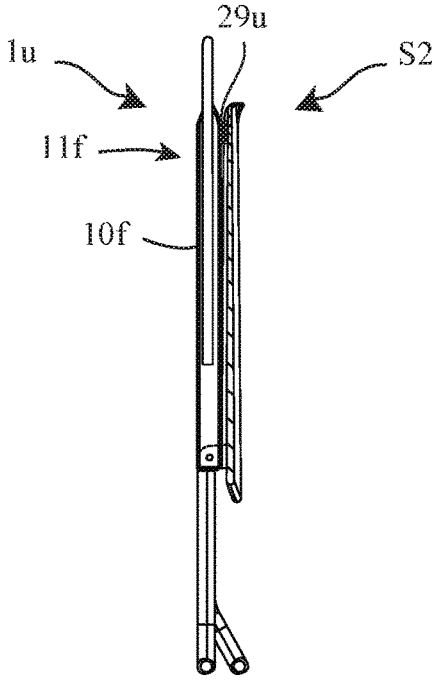

Please refer to FIG. 24 and FIG. 24A, 24B for the folding chair 1*u* according to a sixteenth embodiment. The major difference between this embodiment and the seventh embodiment is that the linking mechanism 22*f* is not connected to the back 30*f* or the actuating member 21*f* in this embodiment. Also, in this embodiment, the interlinking device 20*u* comprises a locking member 29*u*. The locking member 29*u* is a pair of magnetic members 291*u* which attract each other, such as magnets in this embodiment. The pair of locking members 29*u* are disposed at the upper end 31*f* of the back 30*f* and the front end 11*f* of the seat 10*f*. A user can rotate the back 30*f* directly by hand or pull or push the initial activating member 23*f* to transition the folding chair 1*u* between the unfolded state S1 and folded state S2. When the folding chair 1*u* is in the folded state S2, the magnetic members 291*u* attract each other and cause the back 30*f* and the seat 10*f* to remain close to each other. It should be noted that the locking members 29*u* can also be snaps, suction cups, locks, or other such devices, as long as they can make the back 30*f* and the seat 10*f* remain closed in the folded state S2. In addition, even if there is no initial activating member 23*f*, users can also pull the front leg 50*f* and the rear leg 40*f* to fold or unfold the folding chair 1*u* manually.

Figure 25:
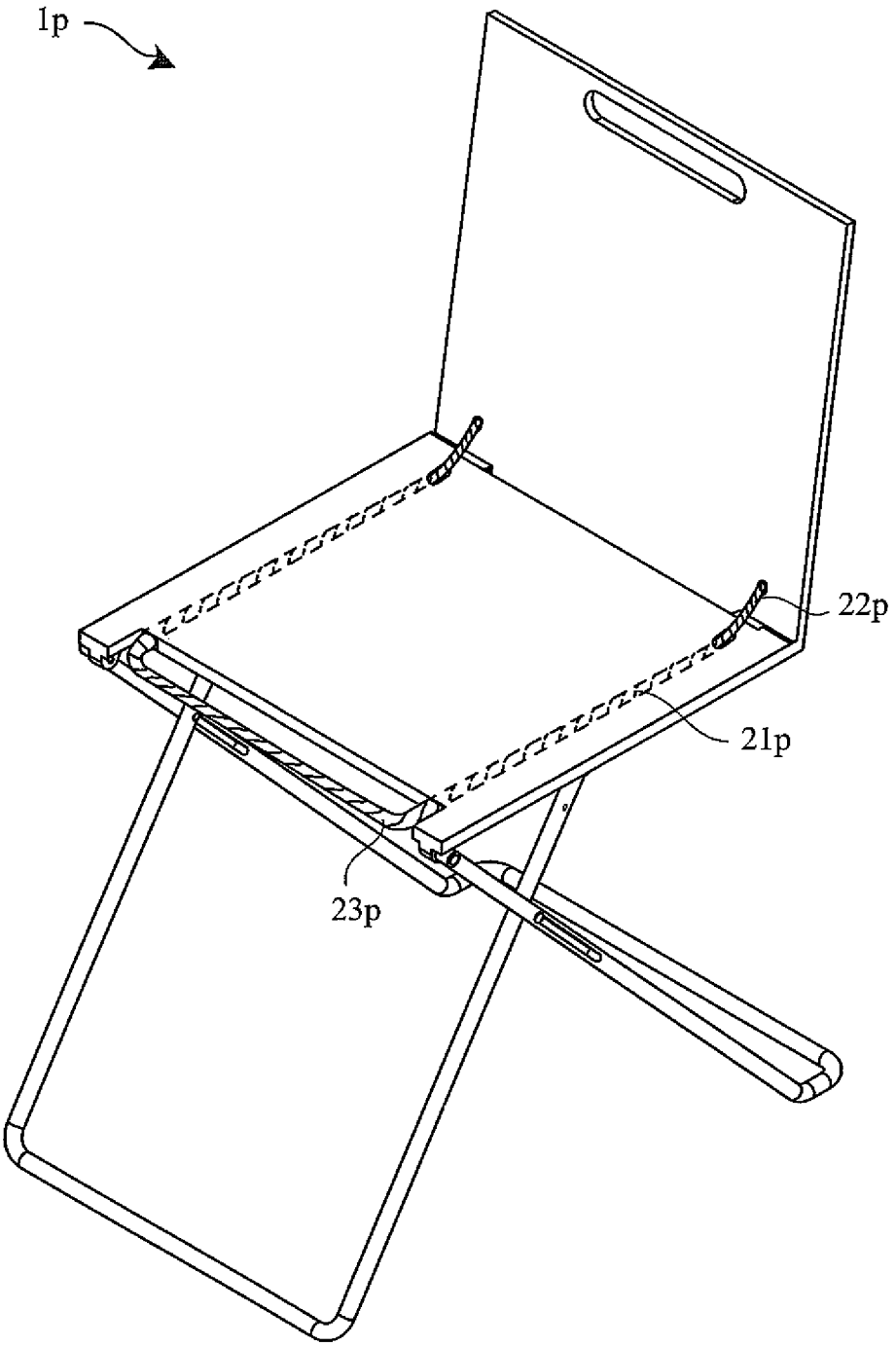
FIG. 25 provides a perspective view showing the unfolded state of the folding chair according to a seventeenth embodiment of the present invention.

Please refer to FIG. 25 for the folding chair 1*p* according to a seventeenth embodiment. The major difference between this embodiment and the first embodiment is that the linking mechanism 22*p*, the actuating members 21*p* and the initial activating member 23*p* are made of flexible materials in the form of ropes, belts, rubber strips, chains or flexible tubes in this embodiment. It should be noted that in previous embodiments and in this embodiment, members such as the linking mechanisms 22, 22*d*, 22*i*, the actuating members 21, 21*d*, the main actuating members 211*g*, 211*i*, the initial activating members 23, 23*d*, 23*f*, 23*g*, and the secondary actuating members 212*f*, 212*g*, etc., can be completely or partially made of flexible materials or a mix of rigid materials and flexible materials.

Figure 26:
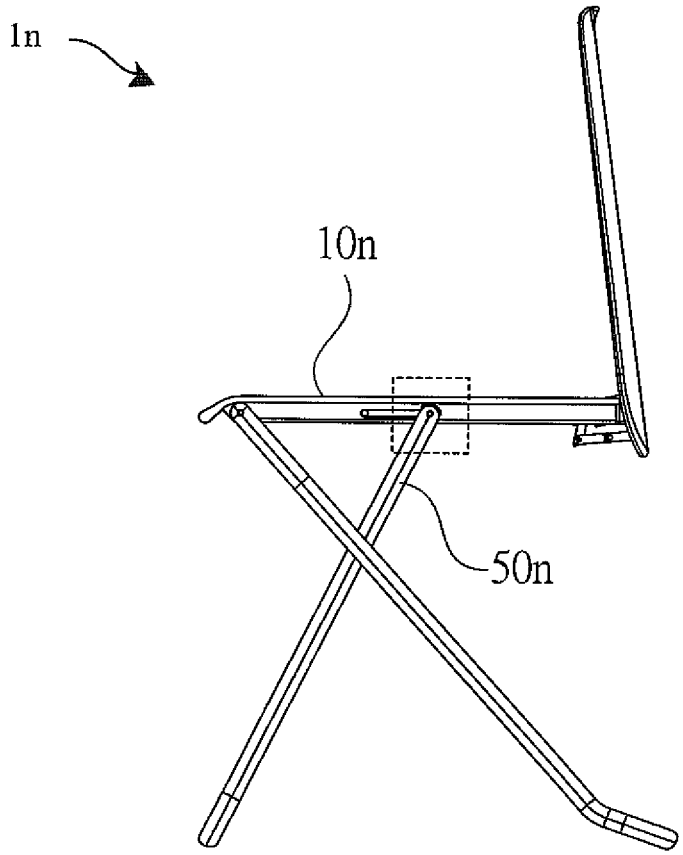
FIG. 26 and FIG. 26A provide side views and partial enlarged views showing the unfolded state of the folding chair according to an eighteenth embodiment of the present invention.
Figure 26A:
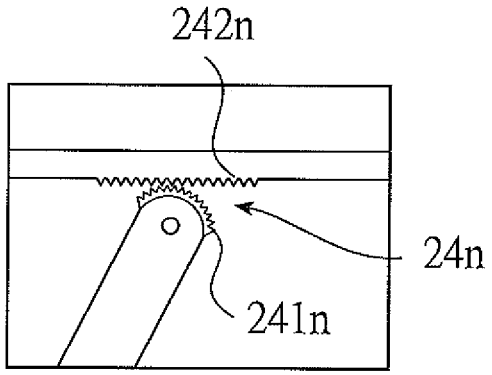

Please refer to FIG. 26 and FIG. 26A for the folding chair 1*n* according to an eighteenth embodiment of the present invention. The major difference between this embodiment and the seventh embodiment is that the leg guiding member 24*n* comprises a first gear member 241*n* and a second gear member 242*n*. The first gear member 241*n* is disposed at the front leg 50*f*, and the second gear member 242*n* is disposed at the seat 10*n*. The two gear members are engaged, which causes the front leg 50*n* to rotate relative to the seat 10*n* when the front leg 50*n* moves. It should be noted that the leg guiding member 24*n* and the seat 10*n* can be coupled in different ways, such as by applying cam mechanisms or being driven by friction, and are not restricted to the above-mentioned embodiments.

Although the present invention has been explained in relation to its preferred embodiments, it is to be understood that many other possible modifications and variations can be made without departing from the spirit and scope of the invention as hereinafter claimed. For example, the purposes of the different components of the interlinking device 20, such as the linking mechanism 22, the actuating members 21, the leg guiding member 24, and so on in the above embodiments are to interlink the seat 10, the back 30, the front leg 50, and the rear leg 40 such that the folding chair 1 can fold or unfold. As long as it can achieve the same goal, the interlinking device 20 can consist of any known mechanism such as linkages, gears, cams, belts or other kinds of components.

Additionally, since the function of the initial activating member 23*f* and the secondary actuating member 212*f* is to make it easier for users to activate the folding function of the folding chair 1*f*; other known actuating mechanisms which have been applied in other products such as luggage handles, buttons, or ball-point pens can also be applied to activate the interlinking device 20 of the present invention. Furthermore, other known driving elements such as springs, magnets, motors, hydraulic pressure devices, air pressure devices, or other components which are driven by mechanical, electronic, magnetic, or other kinds of forces can be applied to drive the actuating members 21, the linking mechanism 22, or other mechanism members of the present invention.

In addition, since users can fold or unfold the folding chair 1 by operating the back 30, the initial activating member 23 and the secondary actuating member 212*f* are not necessary in the above embodiments. Furthermore, it is possible to attach extra parts on the front leg 50 or the rear leg 40, such as wheels, to make the legs move more smoothly in order to facilitate the folding process when the user folds or unfolds the folding chair 1 by pushing on the back 30.

Since the members of the folding chair are interlinked, the assisted actuating members can be disposed at different positions, such as the back 30, the seat 10, the interlinking device 20, the front leg 50, and the rear leg 40 to actuate the folding or unfolding function.

Also, the guiding portions 13 and the actuating members 21 are not restricted to the above-mentioned embodiments, nor are their positions restricted to locations inside the seat 10 as long as the actuating members 21 are movably coupled to the guiding portions 13 and are able to actuate the folding and unfolding function.

On the other hand, in the folded state S2, users can also choose to push the initial activating member 23 to actuate the interlinking device 20 instead of pulling on the back 30 to unfold the folding chair 1. Meanwhile, users can grasp the initial activating member 23 to move and transport the folding chair 1. In addition, the initial activating member 23 can function as a hanger, which allows users to hang the folding chair 1 on walls or hooks as an alternative storage option.

Please note that the meaning of "be coupled" in the above specification should refer to connecting, pivoting, contacting, and engaging, etc.

It must be noted that the above-mentioned embodiments are only for illustration. It is intended that the present invention cover modifications and variations of this invention provided that they fall within the scope of the following claims and their equivalents. Therefore, it will be apparent to those skilled in the art that various modifications can be made to the structure of the present invention without departing from the scope or spirit of the invention.

What is claimed is:

1. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein the back further comprises a back lower end, which is lower than the top surface in the unfolded state, wherein the interlinking device further comprises a linking mechanism, wherein the linking mechanism is coupled to the back lower end, and wherein when the folding chair transitions from the unfolded state to the folded state, the back is rotated by the linking mechanism.

2. The folding chair as claimed in claim 1, wherein the linking mechanism is coupled to the back and to any of the following components: the at least one actuating member, the front leg, and the rear leg.

3. The folding chair as claimed in claim 1, wherein the at least one actuating member moves along the direction from the rear end toward the front end in the transition from the unfolded state to the folded state, and wherein the at least one actuating member moves along the direction from the front end toward the rear end in the transition from the folded state to the unfolded state.

4. The folding chair as claimed in claim 2, wherein the linking mechanism further comprises a rotary member and a back coupling member, wherein the back coupling member is coupled to the back; wherein the rotary member is pivotally coupled to the seat, and wherein the at least one actuating member is coupled to the back coupling member by the rotary member.

5. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein the interlinking device further comprises a leg guiding member and a linking mechanism, wherein the linking mechanism is coupled to the back, wherein the leg guiding member is coupled to the seat and to the front leg, or to the at least one actuating member and to the rear leg, and wherein when the folding chair transitions from the unfolded state to the folded state, the back is rotated by the linking mechanism.

6. The folding chair as claimed in claim 5, wherein the linking mechanism is coupled to the back and to any of the following components: the at least one actuating member, the front leg, and the rear leg.

7. The folding chair as claimed in claim 5, wherein the interlinking device further comprises an initial activating member, and wherein the initial activating member is coupled to the at least one actuating member.

8. The folding chair as claimed in claim 5, wherein the at least one actuating member moves along the direction from the rear end toward the front end in the transition from the unfolded state to the folded state, and wherein the at least one actuating member moves along the direction from the front end toward the rear end in the transition from the folded state to the unfolded state.

9. The folding chair as claimed in claim 5, wherein the rear leg is pivotally coupled to the front leg about an axis, wherein the front and rear legs are parallel to each other from the axis to the seat in the folded state, and wherein the folding chair is capable of standing upright without any external support in the folded state.

10. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein the interlinking device further comprises an initial activating member, and wherein the initial activating member is coupled to the at least one actuating member; and wherein the interlinking device further comprises a linking mechanism, wherein the linking mechanism is coupled to the back, and wherein when the folding chair transitions from the unfolded state to the folded state, the back is rotated by the linking mechanism.

11. The folding chair as claimed in claim 10, wherein the linking mechanism is coupled to the back and to any of the following components: the at least one actuating member, the front leg, and the rear leg.

12. The folding chair as claimed in claim 10, wherein the at least one actuating member further comprises a main actuating member and a secondary actuating member, wherein the secondary actuating member is coupled to the main actuating member and one of the following components: the linking mechanism, the initial activating member, and the back, and wherein a function of the secondary actuating member is to cause the back to rotate when the chair transitions between the unfolded state and the folded state.

13. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein the interlinking device further comprises an initial activating member, and wherein the initial activating member is coupled to the at least one actuating member; and wherein the at least one actuating member moves along the direction from the rear end toward the front end in the transition from the unfolded state to the folded state, and wherein the at least one actuating member moves along the direction from the front end toward the rear end in the transition from the folded state to the unfolded state.

14. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein when the folding chair is in the folded state, and the folding chair is capable of standing upright without any external support; and wherein the interlinking device further comprises a linking mechanism, wherein the linking mechanism is coupled to the back, and wherein when the folding chair transitions from the unfolded state to the folded state, the back is rotated by the linking mechanism.

15. The folding chair as claimed in claim 14, wherein the linking mechanism is coupled to the back and to any of the following components: the at least one actuating member, the front leg, and the rear leg.

16. A folding chair which can have an unfolded state and a folded state, comprising:

a seat comprising a front end, a rear end, at least one guiding portion, and a top surface;

a back pivotally coupled to the seat;

an interlinking device comprising at least one actuating member, wherein the at least one actuating member is movably coupled to the at least one guiding portion;

a front leg separated and independent from the back, wherein the front leg is pivotally coupled to the at least one actuating member, such that when the folding chair transitions between the unfolded state and the folded state, the front leg is driven by the interlinking device;

a rear leg coupled to the seat and the front leg;

whereby, when the interlinking device is actuated, the folding chair is able to transition between the unfolded state and the folded state;

wherein when the interlinking device is actuated, the folding chair transitions between the unfolded state and the folded state such that:

when the folding chair transitions from the unfolded state to the folded state, the front leg and the rear leg rotate along a counterclockwise folding direction relative to the seat, and when the folding chair transitions from the folded state to the unfolded state, the front leg and the rear leg rotate along a clockwise unfolding direction relative to the seat.

17. The folding chair as claimed in claim 16, wherein the interlinking device further comprises an initial activating member, and wherein the initial activating member is coupled to the at least one actuating member.

18. The folding chair as claimed in claim 17, wherein the initial activating member is located at the front end in the unfolded state.

19. The folding chair as claimed in claim 18, wherein the front end comprises an opening, and wherein the initial activating member is located at the opening in the unfolded state.

20. The folding chair as claimed in claim 16, wherein the front leg further comprises a leg coupling member which is capable of moving relative to the rear leg.

21. The folding chair as claimed in claim 16, wherein when the folding chair is in the folded state, the folding chair is capable of standing upright without any external support.

22. The folding chair as claimed in the claim 21, wherein the rear leg or the front leg further comprises a supportive structure, such that the folding chair is capable of standing upright without any external support.

23. The folding chair as claimed in the claim 22, wherein the supportive structure is a bent part.

24. The folding chair as claimed in claim 21, wherein the interlinking device further comprises an initial activating member, and wherein the initial activating member is coupled to the at least one actuating member.

* * * * *